US005342335A

United States Patent [19]

Rhim

[11] Patent Number: 5,342,335

[45] Date of Patent: Aug. 30, 1994

[54] NONWOVEN WEB OF POLY(VINYL ALCOHOL) FIBERS

[75] Inventor: Hannong Rhim, Roswell, Ga.

[73] Assignee: Kimberly-Clark Corporation, Neenah, Wis.

[21] Appl. No.: 172,018

[22] Filed: Dec. 22, 1993

Related U.S. Application Data

[63] Continuation of Ser. No. 810,470, Dec. 19, 1991, abandoned.

[51] Int. Cl.[5] ..... A61F 13/15; A61F 13/20

[52] U.S. Cl. ..... 604/367; 604/358; 604/374

[58] Field of Search ..... 604/358, 365, 367, 368, 604/374, 375, 376; 525/56; 428/224, 913

[56] References Cited

U.S. PATENT DOCUMENTS

| | | | |
|---|---|---|---|
| 2,357,392 | 9/1944 | Francis, Jr. | 13/47.5 |
| 2,411,660 | 11/1946 | Manning | 154/101 |
| 2,464,301 | 3/1949 | Francis, Jr. | 154/4.6 |
| 2,483,406 | 10/1949 | Francis, Jr. | 154/29 |
| 2,571,457 | 10/1951 | Ladisch | 18/54 |
| 2,988,469 | 6/1961 | Watson | 154/101 |
| 3,016,599 | 1/1962 | Perry | 28/78 |
| 3,073,735 | 1/1963 | Till et al. | 156/38 |
| 3,110,642 | 11/1963 | Harrington, Jr. et al. | 156/28 |
| 3,341,394 | 9/1967 | Kinney | 161/172 |
| 3,379,811 | 4/1968 | Hartmann et al. | 264/210 |
| 3,429,953 | 2/1969 | Crompton | 264/8 |
| 3,483,405 | 10/1949 | Francis, Jr. | 154/54 |
| 3,535,415 | 10/1970 | Ultee | 265/205 |
| 3,655,862 | 4/1972 | Dorschner et al. | 264/290 |
| 3,689,342 | 9/1972 | Vogt et al. | 156/167 |
| 3,692,618 | 9/1972 | Dorschner et al. | 161/72 |
| 3,704,198 | 11/1972 | Prentice | 161/148 |

(List continued on next page.)

FOREIGN PATENT DOCUMENTS

| | | | |
|---|---|---|---|
| 3901518A1 | 7/1990 | Fed. Rep. of Germany . | |
| 90/2970B | 1/1990 | Japan . | |
| 827644 | 2/1960 | United Kingdom | 109/120 |

OTHER PUBLICATIONS

Ichiro Sakurada, "Polyvinyl Alcohol Fibers." Marcel Dekker, Inc., New York, 1985, pp. 249–267.

V. A. Wente, "Superfine Thermoplastic Fibers", Industrial and Engineering Chemistry, vol. 48, No. 8, pp. 1342–1346 (1956).

(List continued on next page.)

*Primary Examiner*—Randall L. Green
*Assistant Examiner*—P. Zuttarelli

[57] ABSTRACT

A nonwoven web of poly(vinyl alcohol) fibers which is prepared by a method comprising the steps of (1) preparing an aqueous polymer solution of a defined poly(vinyl alcohol); (2) extruding the resulting polymer solution under defined conditions through a die having a plurality of orifices to form a plurality of threadlines; (3) attenuating the resulting threadlines with a defined primary gaseous source to form fibers under conditions of controlled macro scale turbulence and under conditions sufficient to permit the viscosity of each threadline, as it leaves a die orifice and for a distance of no more than about 8 cm, to incrementally increase with increasing distance from the die, while substantially maintaining uniformity of viscosity in the radial direction, at a rate which is sufficient to provide fibers having the desired attenuation and mean fiber diameter without significant fiber breakage; (4) drying the attenuated threadlines with a defined secondary gaseous source; and (5) depositing the resulting fibers randomly on a moving foraminous surface to form a substantially uniform web, the moving foraminous surface being from about 10 to about 100 cm from the opening from which the last gaseous source to contact the threadlines emerges, which fibers have a mean fiber diameter in the range of from about 0.1 to about 30 μm and are substantially free of shot, with the attenuating and drying steps being carried out under conditions of controlled macro scale turbulence.

28 Claims, 20 Drawing Sheets

U.S. PATENT DOCUMENTS

| | | | |
|---|---|---|---|
| 3,705,068 | 12/1972 | Dobo et al. | 156/441 |
| 3,752,613 | 8/1973 | Vogt et al. | 425/80 |
| 3,755,527 | 8/1973 | Keller et al. | 264/210 |
| 3,770,856 | 11/1973 | Ueki | 264/13 |
| 3,772,417 | 11/1973 | Vogt | 264/236 |
| 3,801,400 | 4/1974 | Vogt et al. | 156/167 |
| 3,802,817 | 4/1974 | Matsuki et al. | 425/66 |
| 3,849,241 | 11/1974 | Butin et al. | 161/169 |
| 3,853,651 | 12/1974 | Porte | 156/73.6 |
| 3,914,354 | 10/1975 | Ueki et al. | 264/13 |
| 3,978,185 | 8/1976 | Buntin et al. | 264/93 |
| 4,011,067 | 3/1977 | Carey, Jr. | 55/354 |
| 4,042,740 | 8/1977 | Krueger | 428/138 |
| 4,043,331 | 8/1977 | Martin et al. | 128/156 |
| 4,064,605 | 12/1977 | Akiyama et al. | 28/103 |
| 4,091,140 | 5/1978 | Harmon | 428/288 |
| 4,100,319 | 7/1978 | Schwartz | 428/171 |
| 4,100,324 | 7/1978 | Anderson et al. | 428/288 |
| 4,103,058 | 7/1978 | Humlicek | 428/171 |
| 4,104,340 | 8/1978 | Ward | 264/6 |
| 4,118,531 | 10/1978 | Hauser | 428/224 |
| 4,137,379 | 1/1979 | Schmidt | 429/254 |
| 4,174,417 | 11/1979 | Rydell | 428/221 |
| 4,211,737 | 7/1980 | Di Drusco et al. | 264/12 |
| 4,234,652 | 11/1980 | Vanoni et al. | 428/296 |
| 4,238,175 | 12/1980 | Fujii et al. | 425/83.1 |
| 4,295,809 | 10/1981 | Mikami et al. | 425/72 |
| 4,340,563 | 7/1982 | Appel et al. | 264/518 |
| 4,355,081 | 10/1982 | Kinsley, Jr. | 428/526 |
| 4,375,446 | 3/1983 | Fujii et al. | 264/518 |
| 4,381,320 | 4/1983 | Nguyen | 604/368 |
| 4,405,297 | 9/1983 | Appel et al. | 425/72 |
| 4,429,001 | 1/1984 | Kolpin | 428/283 |
| 4,434,204 | 2/1984 | Hartman et al. | 428/198 |
| 4,468,241 | 8/1984 | Briedenthal, Jr. | 65/5 |
| 4,627,811 | 12/1986 | Greiser et al. | 425/72 |
| 4,644,045 | 2/1987 | Fowells | 526/348 |
| 4,663,220 | 5/1987 | Wisneski et al. | 428/221 |
| 4,726,901 | 2/1988 | Pall et al. | 210/496 |
| 4,734,227 | 3/1988 | Smith | 264/13 |
| 4,741,941 | 5/1988 | Englebert et al. | 428/71 |
| 4,755,178 | 7/1988 | Insley et al. | 604/367 |
| 4,808,367 | 2/1989 | Homma et al. | 264/555 |
| 4,855,179 | 8/1989 | Bourland et al. | 428/296 |
| 4,968,471 | 11/1990 | Ito et al. | 264/184 |
| 4,971,861 | 11/1990 | Watanabe et al. | 428/364 |

OTHER PUBLICATIONS

V. A. Wente et al., "Manufacture of Superfine Organic Fibers", Navy Research Laboratory, Washington, D.C., NRL Report 4364 (111437) May 25, 1954.

Robert R. Butin and Dwight T. Lohkamp, "Melt Blowing—A One-Step Web Process for New Nonwoven Products", Journal of the Technical Association of the Pulp and Paper Industry, vol. 56, No. 4, pp. 74–77 (1973).

NONWOVEN WEB OF POLY(VINYL ALCOHOL) FIBERS

This application is a continuation of application Ser. No. 07/810,470 entitled "METHOD OF PREPARING A NONWOVEN WEB OF POLY (VINYL ALCOHOL) FIBERS" and filed in the U.S. Patent and Trademark Office on Dec. 19, 1991, now abandoned.

BACKGROUND OF THE INVENTION

The present invention relates to nonwoven webs of poly(vinyl alcohol) fibers. More particularly, the present invention relates to a method of preparing a nonwoven web of poly(vinyl alcohol) fibers.

Continuous filaments of poly(vinyl alcohol), i.e., poly(vinyl alcohol) textile fibers, in general are prepared by either wet spinning or dry spinning. Wet spinning generally involves extruding an aqueous solution of the polymer into a coagulating bath, such as a solution of sodium sulfate in water. Dry spinning, on the other hand, generally involves extruding an aqueous solution of the polymer into air. In this case, though, the polymer solution typically is highly concentrated and the extruded liquid filaments are solidified, dried, hot-drawn, and heat-treated in a gaseous environment. Wet spinning also has been utilized for the production of filaments from a water-insoluble, thermoplastic polymer, poly (ethylene terephthalate); see U.S. Pat. No. 4,968,471 to Ito et al.

Dry spinning is classified into two types: (a) low-draft spinning and (b) high-draft spinning. The two types differ in the magnitude of the draft which is defined as the ratio of the take-up speed of the filaments to the extrusion speed of the spinning solution from the die. For a general discussion of the dry spinning of poly (vinyl alcohol), see Ichiro Sakurada, "Polyvinyl Alcohol Fibers," Marcel Dekker, Inc., New York, 1985, pp. 249–267.

The basic principles involved in dry spinning have been applied to the formation of nonwoven webs. For example, U.S. Pat. No. 4,855,179 to Bourland et al. describes the production of superabsorbent articles in the form of soft, nonwoven fibrous webs. Such a web is produced from an aqueous fiber-forming polymer solution by first forming the polymer solution into filaments which are contacted with a primary air stream having a velocity sufficient to attenuate the filaments. The attenuated filaments are contacted in a fiber-forming zone with a secondary air stream having a velocity effective to further attenuate and to fragment the filaments into fibers and to transport the fibers to a web-forming zone. The fibers are collected in reticulated web form in the web-forming zone, and the web is cured. Hydrophilic thermosetting and thermoplastic polymer compositions of all types are stated to be useful in the foregoing process. However, such process allegedly has particular applicability when the polymer composition comprises a blend of (1) a copolymer of at least one alpha, beta-unsaturated carboxylic monomer and at least one monomer copolymerizable therewith, and (2) a crosslinking agent comprising hydroxyl or heterocyclic carbonate groups.

European Published Patent Application No. 0 176 316 A2 describes a nonwoven fabric of water-soluble resin fibers. The fabric consists of water-soluble resin fine fibers having a mean fiber diameter of 30 μm or less and a basis weight of 5 to 500 g/m$^2$. The fabric is produced by extruding an aqueous solution comprising a water-soluble resin or a melt of a water-soluble resin plasticized with water through nozzles, stretching the extruded material to form fibers by a high speed gas flow, heating the fibers to evaporate the water in the fibers, and then collecting the fibers. The water-soluble resins which can be used are stated to include poly (vinyl alcohol), although the application clearly is directed primarily to the use of pullulan, a natural glucan. The high speed gas flow typically consists of air at a temperature of from 20° C. to 60° C. and having a linear velocity of, e.g., 10 to 1,000 m/sec. Drying of the fibers is accomplished by banks of infrared heaters located on both sides of and parallel to the fiber stream.

Other methods of forming fibrous webs or products from a solution of a polymer (or molten polymer) are described in, by way of illustration only, U.S. Pat. Nos. 2,357,392 to Francis, Jr.; 2,411,660 to Manning; 2,464,301 to Francis, Jr.; 2,483,405 to Francis, Jr.; 2,483,406 to Francis, Jr.; 2,988,469 to Watson; 3,110,642 to Harrington et al.; and 4,234,652 to Vanoni et al. Such methods typically produce very short fibers and, consequently, differ significantly from the more traditional meltblowing or spunbonding processes which commonly are used to prepared nonwoven webs from molten thermoplastic polymers. See also U.S. Pat. Nos. 2,571,457 to Ladisch; 3,016,599 to Perry, Jr.; 3,073,735 to Till et al.; 3,379,811 to Hartmann et al.; 3,429,953 to Crompton; 3,535,415 to Ultee; 3,689,342 to Vogt et al.; 3,752,613 to Vogt et al.; 3,770,856 to Ueki et al.; 3,772,417 to Vogt; 3,801,400 to Vogt et al.; 3,914,354 to Ueki et al.; 4,011,067 to Carey, Jr.; 4,042,740 to Krueger; 4,043,331 to Martin et al.; 4,103,058 to Humlicek; 4,104,340 to Ward; 4,118,531 to Hauser; 4,137,379 to Schmidt et al.; 4,429,001 to Kolpin et al.; 4,726,901 to Pall et al.; 4,741,941 to Englebert et al.; and 4,755,178 to Insley et al.; British Patent No. 827,644; and Japanese Patent No. 90/2,970B.

The use of steam in fiber-forming processes is illustrated by, for example, U.S. Pat. Nos. 2,571,457, supra; 3,110,642 supra; 3,379,811, supra; 4,211,737 to Di Drusco et al.; 4,355,081 to Kinsley, Jr.; and 4,468,241 to Breidenthal et al. Note that (1) U.S. Pat. No. 4,808,367 to Homma et al. describes a water-containing polymeric composition which can be extruded under conditions such that the flashing of water is prevented, (2) U.S. Pat. No. 4,734,227 to Smith describes the formation of fibers using a supercritical fluid solution, and (3) U.S. Pat. No. 4,174,417 to Rydell relates to the spraying of water-imbibed gelled fibers to form webs.

Traditional meltblowing processes are illustrated by, for example, U.S. Pat. Nos. 3,016,599 to Perry, Jr.; 3,704,198 to Prentice; 3,755,527 to Keller et al.; 3,849,241 to Butin et al.; 3,978,185 to Butin et al.; 4,295,809 to Mikami et al.; 4,375,446 to Fujii et al.; and 4,663,220 to Wisneski et al. See, also, V. A. Wente, "Superfine Thermoplastic Fibers", *Industrial and Engineering Chemistry,* Vol. 48, No. 8, pp. 1342–1346 (1956); V. A. Wente et al., "Manufacture of Superfine Organic Fibers" Navy Research Laboratory, Washington, D.C. , NRL Report 4364 (111437), dated May 25, 1954, United States Department of Commerce, Office of Technical Services; and Robert R. Butin and Dwight T. Lohkamp, "Melt Blowing-A One-Step Web Process for New Nonwoven Products", *Journal of the Technical Association of the Pulp and Paper Industry,* Vol. 56, No. 4, pp. 74–77 (1973).

Coforming references (i.e., references disclosing a meltblowing process in which fibers or particles are comingled with the meltblown fibers as they are formed) include U.S. Pat. Nos. 4,100,324 to Anderson et al.; 4,118,531 to Hauser; 4,238,175 to Fujii et al.; and 4,442,062 to Fujii et al.

Finally, spunbonding references include, among others, U.S. Pat. Nos. 3,341,394 to Kinney; 3,655,862 to Dorschner et al.; 3,692,618 to Dorschner et al.; 3,705,068 to Dobo et al.; 3,802,817 to Matsuki et al.; 3,853,651 to Porte; 4,064,605 to Akiyama et al.; 4,091,140 to Harmon; 4,100,319 to Schwartz; 4,340,563 to Appel et al.; 4,405,297 to Appel et al.; 4,434,204 to Hartman et al.; 4,627,811 to Greiser et al.; and 4,644,045 to Fowells.

Although many advances have been made over the years in the formation of fibers and nonwoven webs from natural and synthetic polymers, there still is a need for improvements. This is particularly true in the formation of nonwoven webs from poly(vinyl alcohol), where known processes have a pronounced tendency to give webs having one or more of a number of deficiencies. Such deficiencies include poor web formation, namely, significant basis weight variation on a relatively small scale defined hereinafter; significant amounts of shot, i.e., small particles of solidified polymer separate from or associated with the fibers making up the web; and highly variable fiber diameters.

SUMMARY OF THE INVENTION

It therefore is an object of the present invention to provide a method of preparing a significantly improved nonwoven web comprised of substantially continuous poly(vinyl alcohol) fibers.

It also is an object of the present invention to provide a method of preparing a significantly improved nonwoven web comprised of continuous poly(vinyl alcohol) fibers.

Another object of the present invention is to provide a significantly improved nonwoven web comprised of substantially continuous poly(vinyl alcohol) fibers.

A further object of the present invention is to provide a significantly improved nonwoven web comprised of continuous poly(vinyl alcohol) fibers.

Still another object of the present invention is to provide a disposable absorbent product which includes a significantly improved nonwoven web comprised of substantially continuous poly(vinyl alcohol) fibers.

Yet another object of the present invention is to provide a disposable absorbent product which includes a significantly improved nonwoven web comprised of continuous poly(vinyl alcohol) fibers.

These and other objects will be apparent to one having ordinary skill in the art from a consideration of the specification and claims which follow.

Accordingly, the present invention provides a method of preparing a significantly improved nonwoven web comprised of substantially continuous poly(vinyl alcohol) fibers which comprises the steps of:

A. preparing an aqueous polymer solution which comprises from about 10 to about 75 percent by weight of a poly(vinyl alcohol) having a molecular weight of from about 30,000 to about 186,000 and a degree of hydrolysis of from about 71 to about 99 percent;

B. extruding the resulting polymer solution at a temperature of from about 20° C. to about 180° C. and a viscosity of from about 3 to about 50 Pa sac through a die having a plurality of orifices to form a plurality of threadlines, which orifices have diameters in the range of from about 0.20 to about 1.2 mm;

C. attenuating the resulting threadlines with a primary gaseous source under conditions sufficient to permit the viscosity of each threadline, as it leaves a die orifice and for a distance of no more than about 8 cm, to incrementally increase with increasing distance from the die, while substantially maintaining uniformity of viscosity in the radial direction, at a rate which is sufficient to provide fibers having the desired attenuation and mean fiber diameter without significant fiber breakage, in which said primary gaseous source has a relative humidity of from about 70 to 100 percent, a temperature of from about 20° C. to about 100° C., a velocity of from about 150 to about 400 m/s, a horizontal angle of incidence of from about 70° to about 110°, and a vertical angle of incidence of no more than about 90°;

D. drying the threadlines to form fibers with a secondary gaseous source at a temperature of from about 140° C. to about 320° C. and having a velocity of from about 60 to about 125 m/s, which secondary gaseous source has a horizontal angle of incidence of from about 70° to about 110°, and a vertical angle of incidence of no more than about 90°; and E. depositing the fibers randomly on a moving foraminous surface to form a substantially uniform web on a scale of from about 0.4 to about 1.9 $cm^2$, said moving foraminous surface being from about 10 to about 60 cm from the opening from which the last gaseous source to contact the threadlines emerges, which fibers have a mean fiber diameter in the range of from about 0.1 to about 10 $\mu m$ and are substantially free of shot;

in which said attenuating and drying steps are carried out under conditions of controlled macro scale turbulence and said fibers are of a length such that they can be regarded as continuous in comparison with their diameters.

The present invention also provides a method of preparing a significantly improved nonwoven web comprised of continuous poly(vinyl alcohol) fibers which comprises the steps of:

A. preparing an aqueous polymer solution which comprises from about 10 to about 75 percent by weight of a poly(vinyl alcohol) having a molecular weight of from about 30,000 to about 186,000 and a degree of hydrolysis of from about 71 to about 99 percent;

B. extruding the resulting polymer solution at a temperature of from about 20° C. to about 180° C. and a viscosity of from about 3 to about 50 Pa sec through a die having a plurality of orifices to form a plurality of threadlines, which orifices have diameters in the range of from about 0.20 to about 1.2 mm;

C. attenuating the resulting threadlines with a 2. 0 primary gaseous source under conditions sufficient to permit the viscosity of each threadline, as it leaves a die orifice and for a distance of no more than about 8 cm, to incrementally increase with increasing distance from the die, while substantially maintaining uniformity of viscosity in the radial direction, at a rate which is sufficient to provide fibers having the desired attenuation and mean fiber diameter without significant fiber breakage, in which said primary gaseous source has a relative humidity of from about 70 to 100 percent, a temperature of from about 20° C. to about 100° C., a velocity of from about 30 to about 150 m/s, a horizontal angle of incidence of from about 70° to about 110°, and a vertical angle of incidence of no more than about 90°;

D. drying the threadlines to form fibers with a secondary gaseous source at a temperature of from about 140° C. to about 320° C. and having a velocity of from about 30 to about 150 m/s, which secondary gaseous source has a horizontal angle of incidence of from about 70° to about 110°, and a vertical angle of incidence of no more than about 90°; and E. depositing the fibers randomly on a moving foraminous surface to form a substantially uniform web on a scale of from about 1.9 to about 6.5 $cm^2$, said moving foraminous surface being from about 10 to about 100 cm from the opening from which the last gaseous source to contact the threadlines emerges, which fibers have a mean fiber diameter in the range of from about 10 to about 30 μm and are substantially uniform in diameter; in which said attenuating and drying steps are carried out under conditions of minimal macro scale turbulence.

The present invention further provides a method of preparing a significantly improved nonwoven web comprised of continuous poly(vinyl alcohol) fibers which comprises the steps of:

A. preparing an aqueous polymer solution which comprises from about 10 to about 75 percent by weight of a poly(vinyl alcohol) having a molecular weight of from about 30,000 to about 186,000 and a degree of hydrolysis of from about 71 to about 99 percent;

B. extruding the resulting polymer solution at a temperature of from about 20° C. to about 180° C. and a viscosity of from about 3 to about 50 Pa sec through a die having a plurality of orifices to form a plurality of threadlines, which orifices have diameters in the range of from about 0.20 to about 1.2 mm;

C. conditioning the resulting threadlines with a primary gaseous source under conditions sufficient to permit the viscosity of each threadline, as it leaves a die orifice and for a distance of no more than about 8 cm, to incrementally increase with increasing distance from the die, while substantially maintaining uniformity of viscosity in the radial direction, at a rate which is sufficient to provide fibers having the desired attenuation and mean fiber diameter without significant fiber breakage, in which said primary gaseous source has a relative humidity of from about 70 to 100 percent, a temperature of from about 20° C. to about 100° C., a velocity of less than about 30 m/s, a horizontal angle of incidence of from about 70° to about 110°, and a vertical angle of incidence of about 90°;

D. drying the threadlines to form fibers with a secondary gaseous source at a temperature of from about 140° C. to about 320° C. and having a velocity of less than about 30 m/s, which secondary gaseous source has a horizontal angle of incidence of from about 70° to about 110°, and a vertical angle of incidence of about 90°;

E. attenuating the resulting fibers with a tertiary gaseous source having a temperature of from about 10° C. to about 50° C., a velocity of from about 30 to about 240 m/s, a horizontal angle of incidence of from about 70° to about 110°, and a vertical angle of incidence of no more than about 90°; and F. depositing the fibers randomly on a moving foraminous surface to form a substantially uniform web on a scale of from about 1.9 to about 6.5 $cm^2$, said moving foraminous surface being from about 10 to about 100 cm from the opening from which the last gaseous source to contact the threadlines emerges, which fibers have a mean fiber diameter in the range of from about 10 to about 30 μm and are substantially uniform in diameter; in which said conditioning, drying, and attenuating steps are carried out under conditions of minimal macro scale turbulence.

The present invention also provides a significantly improved nonwoven web comprised of substantially continuous poly(vinyl alcohol) fibers, in which:

A. said poly(vinyl alcohol) has a molecular weight of from about 30,000 to about 186,000 and a degree of hydrolysis of from about 71 to about 99 percent;

B. said fibers have a mean fiber diameter in the range of from about 0.1 to about 10 μm, are substantially free of shot, and are of a length such that they can be regarded as continuous in comparison with their diameters; and C. said web is substantially uniform on a scale of from about 0.4 to about 1.9 $cm^2$, depending on the mean fiber diameter.

The present invention further provides a significantly improved nonwoven web comprised of continuous poly(vinyl alcohol) fibers, in which:

A. said poly(vinyl alcohol) has a molecular weight of from about 30,000 to about 186,000 and a degree of hydrolysis, of from about 71 to about 99 percent;

B. said fibers have a mean fiber diameter in the range of from about 10 to about 30 μm, are essentially free of shot, and are substantially uniform in diameter; and C. said web is substantially uniform on a scale of from about 1.9 to about 6.5 $cm^2$, depending on the mean fiber diameter.

The present invention still further provides a disposable absorbent product which includes a significantly improved nonwoven web comprised of substantially continuous or continuous poly(vinyl alcohol) fibers.

The poly(vinyl alcohol) nonwoven webs of the present invention are particularly useful in the production of such disposable absorbent products as diapers; training pants; catamenial devices, such as sanitary napkins, tampons, and the like; incontinent products; wipes; and the like.

DETAILED DESCRIPTION OF THE INVENTION

Figure 1:
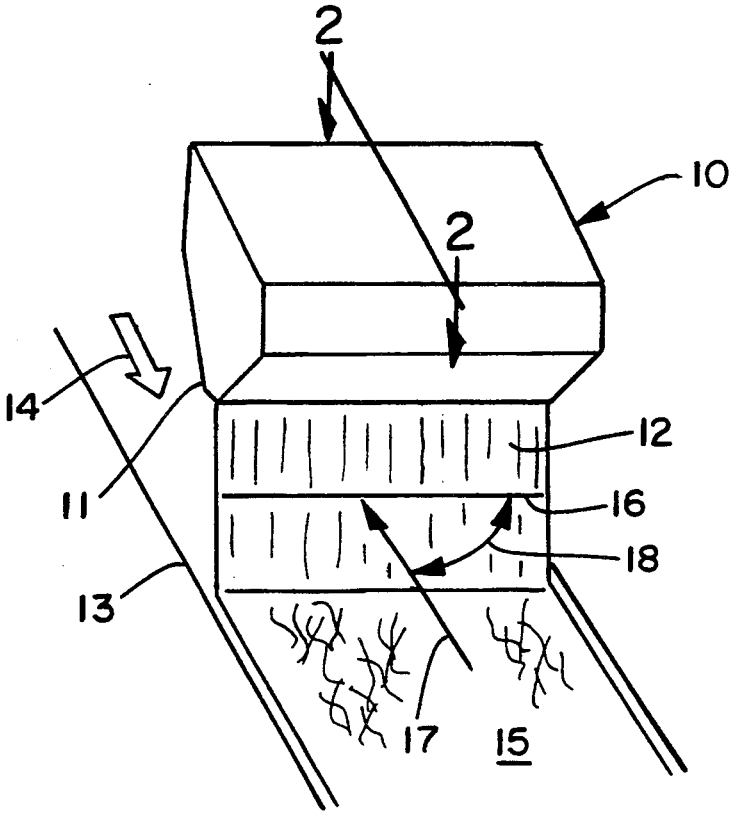
FIG. 1 is a perspective schematic view partially illustrating the preparation of a nonwoven web in accordance with one embodiment of the present invention in order to illustrate the horizontal angle of incidence.

"Web uniformity" is a term which is used herein to refer to the extent to which any portion of a nonwoven web produced in accordance with the present invention having a given area is like any other portion having the same area. Web uniformity typically is a function of fiber diameter and the manner in which fibers are deposited on the moving foraminous surface. Ideally, any given area of the web will be indistinguishable from any other area with respect to such parameters as porosity, void volume, pore size, web thickness, and the like. However, uniformity variations generally are manifested in webs as portions which are thinner than other portions. Such variations can be estimated visually to give a subjective determination of uniformity. Alternatively, web uniformity can be qualitatively estimated by measuring web thickness or light transmission through the web.

The term "relatively small scale" is used throughout this specification in reference to web uniformity and defines the approximate area of each of several portions of the web which are to be compared. In general, the scale typically will be in the range of from about 0.4 to about 6.5 $cm^2$, depending upon the mean fiber diameter. When the mean fiber diameter is 10 $\mu m$ or less, the appropriate area in $cm^2$ for evaluating web uniformity, i.e., the scale, is 0.19 times the mean fiber diameter in $\mu m$ or 0.4 $cm^2$, whichever is greater. That is, the scale is determined by multiplying the mean fiber diameter by 0.19 when the mean fiber diameter is in the range of about 2.1 to about 10 $\mu m$. For mean fiber diameters of about 2.1 $\mu m$ or less, however, the scale is 0.4 $cm^2$. When the mean fiber diameter is greater than 10 $\mu m$, the appropriate multiplier is 0.215. Thus, the phrase "on a scale of from about 0.4 to about 6.5 $cm^2$" means that the area of one portion of a nonwoven web which is to be compared with other portions of the same web, each of which portions has essentially the same area, will be in the range given. Moreover, the area selected, in $cm^2$ as explained above, will be (1) approximately 0.19 times the mean fiber diameter in $\mu m$ when the mean fiber diameter is 10 $\mu m$ or less or 0.4 $cm^2$, whichever is greater, or (2) approximately 0.215 times the mean fiber diameter when the mean fiber diameter is greater than 10 $\mu m$.

As used herein, the term "shot" refers to particles of polymer which generally have diameters greater than the average diameter of the fibers produced by the extrusion process. The production of shot typically is associated with filament breakage and the accompanying accumulation of polymer solution on the die tip.

The term "molecular weight" refers to weight average molecular weight, unless stated otherwise.

The term "turbulence" is used herein to refer to the departure in a fluid, typically a gas, from a smooth or streamlined flow. Thus, the term is meant to apply to the extent or degree to which the fluid flow varies erratically in magnitude and direction with time and thus is essentially variable in pattern. The term "macro scale turbulence" means only that the turbulence is on a scale such that it affects the orientation and spacing of the fibers or fiber segments relative to each other as they approach the web-forming surface, in which the length of such fiber segments is equal to or less than the scale. Turbulence is "controlled" when its magnitude is maintained below an empirically determined level. This minimal turbulence can be achieved by the proper selection of process variables and is permitted to increase only to an extent necessary to achieve a given objective.

Because of the difficulty of measuring turbulence, an indirect means for determining when turbulence is being controlled to a sufficient degree must be used. Such indirect means is web uniformity. Web uniformity, however, as already noted, is often defined as a function of both the area of the web to be evaluated and the mean diameter of the fibers of which the web is composed. For example, most commercial processes for producing nonwoven webs will give a very uniform product if the scale, i.e., the area of the web used for comparison purposes, is large, for example, of the order of several square meters. At the other extreme, uniformity of the same web typically will be very poor if the scale is so small that it is of the order of the mean diameter of the fibers. The scale selected for the evaluation of webs prepared in accordance with the present invention, therefore, is based on commercial experience in producing nonwoven webs by several processes for a variety of applications.

The term "threadline" is used throughout the specification and claims to refer to the shaped article which is formed as the polymer solution is forced through a die orifice but before such shaped article has solidified or dried. Thus, a threadline is essentially liquid or semi-solid. The term "fiber" is used to designate the solidified or dried threadline. Because the transition from a threadline to a fiber is gradual, the use of the two terms cannot be rigorous.

In order to simplify later discussions, it is helpful to define the "back side" and "front side" of the threadline curtain. As used herein, the back side of the curtain is the side toward which the moving foraminous surface approaches. The foraminous surface then passes under the threadline curtain and moves away from it with a nonwoven web having been formed thereon. The side where the web has been formed is the front side of the threadline curtain.

Whenever possible, all units are SI units (International System of Units), whether Basic or Derived. Thus, the unit for viscosity is the pascal-second, abbreviated herein as Pa s. The pascal-second is equal to 10 poise, the more common unit of viscosity.

Turning first to the method of the present invention for preparing a substantially improved nonwoven web comprised of poly(vinyl alcohol) fibers, such method generally comprises the following steps:

A. preparing an aqueous polymer solution of a poly(vinyl alcohol);

B. extruding the resulting polymer solution through a die having a plurality of orifices to form a plurality of threadlines;

C. attenuating the resulting threadlines with a primary gaseous source;

D. drying the attenuated threadlines with a secondary gaseous source to form fibers; and E. depositing the resulting fibers randomly on a moving foraminous surface to form a substantially uniform web.

In general, the first two steps are independent of the apparatus or details of the process employed. As will become evident hereinafter, however, this is not the case for the remaining steps. That is, some of the limitations of the attenuating, drying, and depositing steps depend on whether the poly(vinyl alcohol) fibers produced are substantially continuous or continuous.

The first step (step A) of the method involves preparing an aqueous poly(vinyl alcohol) solution which comprises from about 10 to about 75 percent by weight of the polymer. Because the solubility of the polymer in water is inversely proportional to the polymer molecular weight, higher concentrations, i.e., concentrations above about 40 percent by weight, usually are practical only when polymer molecular weights are below about 100,000. The preferred concentration range is from about 20 to about 60 percent by weight. Most preferably, the concentration of poly(vinyl alcohol) in the solution will be in the range of from about 25 to about 40 percent by weight.

In general, the poly(vinyl alcohol) will have a molecular weight of from about 30,000 to about 186,000 and a degree of hydrolysis of from about 71 to about 99 percent. The preferred ranges are from about 30,000 to about 150,000 and from about 85 to about 99 percent, respectively.

The poly(vinyl alcohol) solution also can contain minor amounts of other materials, i.e., amounts of other materials that together constitute less than 50 percent by weight of the total solids content of the solution. Such other materials include, by way of illustration only, plasticizers, such as polyethylene glycols, glycerin, and the like; colorants or dyes; extenders, such as clay, starch, and the like; cross-linking agents; other functional substances; and the like.

In the second step (step B), the polymer solution is extruded at a temperature of from about 20° C. to about 180° C. and a viscosity at the extrusion temperature of from about 3 to about 50 Pa s through a die having a plurality of orifices to form a plurality of threadlines, which orifices have diameters in the range of from about 0.20 to about 1.2 mm. The extrusion temperature preferably will be in the range of from about 70° C. to about 95° C. The preferred polymer solution viscosity is from about 5 to about 30 Pa s. The orifices in the die preferably will have diameters of from about 0.3 to about 0.6 mm. While the arrangement of the orifices is not known to be critical, the orifices may be arranged in as many as about 7 multiple rows. Such rows usually are essentially perpendicular to the direction of travel of the moving foraminous surface upon which the nonwoven web is formed. Typically, the length of such rows define the width of the web which is formed. Such arrangement of orifices results in a "sheet" or "curtain" of threadlines. The thickness of such curtain is determined by the number of rows of orifices, but it generally is very small in comparison with the width of the curtain. For convenience, such curtain of threadlines occasionally will be referred to herein as the "threadline plane." Such plane typically is perpendicular to the moving foraminous surface upon which the web is formed, although such an orientation is neither essential nor required.

While solution viscosity is a function of temperature, it also is a function of polymer molecular weight, degree of hydrolysis, and the concentration of the polymer in the solution. Consequently, all of these variables need to be taken into consideration in order to maintain the solution viscosity at the extrusion temperature in the proper range. However, such variables are well understood by those having ordinary skill in the art and can be determined readily without the need for undue experimentation.

The resulting threadlines then are attenuated in step C with a primary gaseous source to form fibers under conditions sufficient to permit the viscosity of each threadline, as it leaves a die orifice and for a distance of no more than about 8 cm, to incrementally increase with increasing distance from the die, while maintaining uniformity of viscosity in the radial direction. The rate of threadline attenuation must be sufficient to provide fibers having the desired strength and mean fiber diameter without significant fiber breakage. In general, the primary gaseous source will have a relative humidity of from about 70 to 100 percent and a temperature of from about 20° C. to about 100° C., a horizontal angle of incidence of from about 70° to about 110°, and a vertical angle of incidence of no more than about 90°.

When substantially continuous fibers are being formed, the velocity of the primary gaseous source will be in the range of from about 150 to about 400 m/s. The more preferred primary gaseous source velocity is from about 60 to about 300 m/s. The primary gaseous source velocity most preferably will be in the range of from about 70 to about 200 m/s. For the production of continuous fibers, however, the velocity of the primary gaseous source will be in the range of from about 30 to about 150 m/s.

The foregoing attenuation step involves a balance between attenuating aspects and drying aspects since some loss of water from the threadlines usually is inevitable. However, optimum attenuating conditions may not always coincide with optimum drying conditions. Consequently, a conflict between the two parameters may arise which requires finding a compromise set of conditions.

It is, of course, important that the threadlines be attenuated to the desired level without breakage. An excessive attenuation rate creates excessive stress on the threadlines which leads to frequent threadline or fiber breaks and increased shot formation. This is especially true when microfibers having diameters in the range of from about 0.1 to about 10 μm are being produced. Too slow an attenuation rate, though, fails to give sufficiently strong fibers. On the other hand, too rapid threadline drying, especially during the attenuation step, can result in increased breaks and increased shot production. If threadline drying is too slow during the drying step, excessive interfiber bonding or fusing occurs as a result of the fibers being too wet as they are laid down on the moving foraminous surface. Consequently, ideal drying conditions typically are not optimum for the production of highly attenuated, strong fibers. Thus, the somewhat opposing requirements for attenuating and drying the threadlines are accomplished by controlling the relative humidity and temperature of the primary gaseous source, as well as its velocity. As a general rule, however, the attenuating step typically results in no more than partial drying of the threadlines in order to provide the required incremental increase in threadline viscosity.

Drying of the attenuated and typically partially dried threadlines is accomplished in step D by means of a secondary gaseous source. The secondary gaseous source in general will have a temperature of from about 140° C. to about 320° C. The vertical and horizontal angle of incidence requirements are the same as those for the primary gaseous source. For substantially continuous fiber production the secondary gaseous source will have a velocity of from about 60 to about 125 m/s. The production of continuous fibers requires a secondary gaseous source having a velocity of from about 30 to about 150 m/s.

As used herein, the term "primary gaseous source" means a gaseous source which is the first to contact the threadlines upon their emergence from the die. The term "secondary gaseous source" refers to a gaseous source which contacts the threadlines or fibers after the threadlines have been contacted by the primary gaseous source. Thus, "primary" and "secondary" refer to the order in which two gaseous sources contact the threadlines after they have emerged from the die. Subsequent gaseous sources, if used, would be referred to as "tertiary," "quaternary," and so forth. Although coming within the spirit and scope of the present invention, the use of such subsequent gaseous sources usually is neither practical nor necessary and, consequently, is not preferred, with two exceptions which will be described later.

Each of the gaseous sources required by steps C and D, and each additional gaseous source, if used, preferably will comprise at least two gaseous streams, with two streams being more preferred. When two streams are employed, they typically are located on opposite sides of the threadline curtain or plane. The stream impinging the filaments from the front side of the threadline curtain has, by definition, a positive vertical angle of incidence, whereas the stream impinging the filaments from the back side of the threadline curtain has a negative vertical angle of incidence. However, the absolute value of the vertical angle of incidence for each stream must be within the limitations described herein, although both streams need not have the same absolute value for their vertical angles of incidence. Consequently, it should be understood that the requirement in the claims with respect to the vertical angle of incidence refers to an absolute value when a gaseous source involves more than one gaseous stream.

In the last step of the method of the present invention, step E, the fibers resulting from the previous step are deposited randomly on a moving foraminous surface. In the case of substantially continuous fiber production, the moving foraminous surface is from about 10 to about 60 cm from the opening from which the last gaseous source to contact the threadlines emerges; the distance between the moving foraminous surface and such opening on occasion is referred to herein as the forming distance. Moreover, the mean fiber diameter typically will be in the range of from about 0.1 to about 10 $\mu$m. The fibers generally are substantially uniform in diameter and are substantially free of shot.

When continuous fibers are produced the forming distance preferably will be from about 10 to about 100 cm and the mean fiber diameter will be in the range of from about 10 to about 30 $\mu$m. As a general rule, the production of continuous fibers also typically results in a substantially uniform web.

As stated earlier, the area, or scale, used for comparison purposes in evaluating web uniformity primarily is a function of fiber diameter. Thus the scale for a web comprised of substantially continuous fibers will be in the range of from about 0.4 to about 1.9 $cm^2$, while the scale for a web comprised of continuous fibers will be in the range of from about 1.9 to about 6.5 $cm^2$.

As already noted, step C requires controlled macro scale turbulence and conditions sufficient to permit the viscosity of each threadline, as it leaves a die orifice, to incrementally increase with increasing distance from the die, while maintaining uniformity of viscosity in the radial direction, at a rate which is sufficient to provide fibers having the desired attenuation and mean fiber diameter without significant fiber breakage. The only means presently known for meeting both requirements involves controlling four parameters or variables associated with the gaseous source: relative humidity, temperature, velocity, and orientation relative to the threadline curtain. In general, macro scale turbulence primarily is a function of gaseous stream velocity and the orientation of the gaseous source as it impinges the threadline curtain. The viscosity of the threadline, although affected by gaseous source velocity, primarily is a function of the relative humidity and temperature of the primary gaseous source. Such parameters or variables are discussed below under the headings, "Macro Scale Turbulence" and "Threadline Viscosity."

Macro Scale Turbulence

As already noted, attenuating and drying are carried out under conditions of controlled macro scale turbulence. In a preferred embodiment, attenuating and drying are carried out under conditions of minimal macro scale turbulence, thereby assisting the formation of a web which is substantially uniform. As used herein, the term "minimal macro scale turbulence" means only that degree of turbulence which will permit the desired uniform web formation to occur which is in part dependent on uniform fiber spacing and orientation.

Some turbulence is unavoidable, indeed necessary, given the fact that attenuation results from the entrainment of threadlines in a moving gaseous stream. There is associated with any desired degree of attenuation, however, a minimum gaseous stream velocity which is readily determined empirically by one having ordinary skill in the art. This is true regardless of the orientation of the gaseous source. As a practical matter, the minimum gaseous source velocity will be much higher than the extrusion velocity.

In certain instances, macro scale turbulence will need to be greater than minimal, although still controlled. For example, when fibers or particles are to be comingled with the threadlines as they are formed, a greater degree of turbulence is required in order to achieve a degree of commingling which is sufficient to provide a coherent uniform web.

Macro scale turbulence also is a function of the nature of the gaseous source and its orientation as it impinges the threadline curtain. In addition, the efficiency of threadline attenuation is, at least in part, dependent upon gaseous source orientation. In general, gaseous source orientation is defined by the horizontal angle of incidence and the vertical angle of incidence.

The horizontal angle of incidence is best defined with reference to FIG. 1. FIG. 1 is a perspective schematic view partially illustrating the preparation of a nonwoven in accordance with one embodiment of the present invention. Polymer solution is extruded through a plurality of orifices in face 11 of die 10 to form threadline curtain 12. As threadline curtain 12 meets foraminous belt 13 moving in the direction of arrow 14, nonwoven web 15 is formed. Line 16 lies in the plane of threadline curtain 12 and is parallel with face 11 of die 10. Arrow 17 represents the orientation of a gaseous stream relative to line 16, with the direction of flow being in the same direction as arrow 17. Angle 18 formed by line 16 and arrow 17 is the horizontal angle of incidence. Note that angle 18 is determined relative to the right-hand portion of line 16 with respect to an observer facing die 10, toward whom foraminous belt 13 is moving. In general, the horizontal angle of incidence of each gaseous source will be in the range of from about 70° to about 110°, with an angle of about 90° being preferred.

Figure 2:
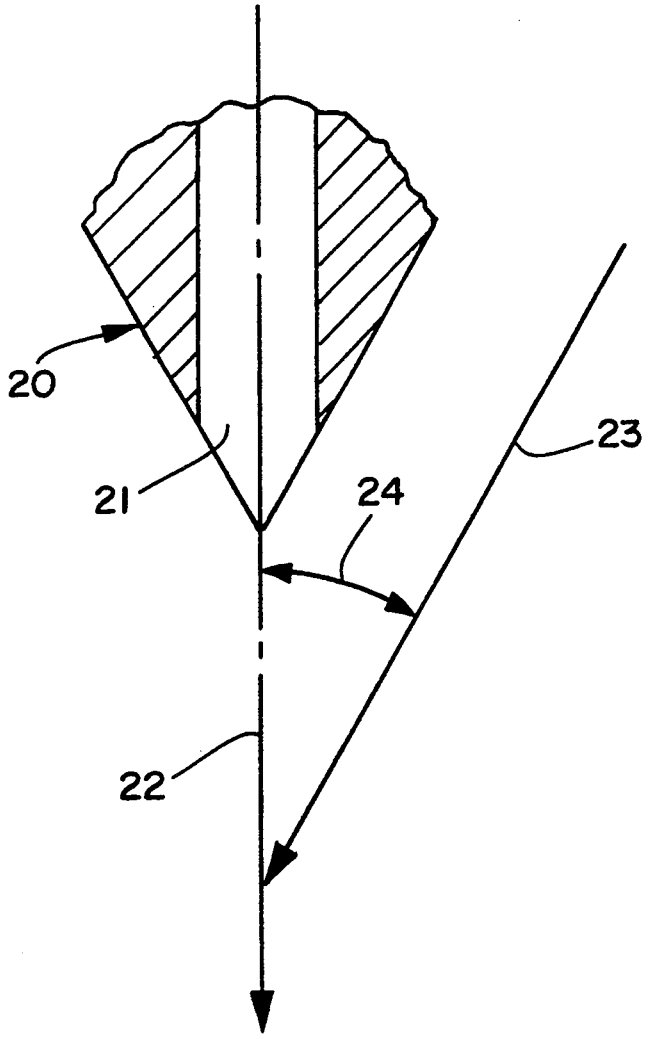
FIG. 2 shows in cross-section the lower part of the die tip portion of the die of FIG. 1, taken along line 2—2. The figure illustrates the vertical angle of incidence.

Similarly, the vertical angle of incidence is best defined with reference to FIG. 2. FIG. 2 shows in cross-section a small portion of die 20 having orifice 21, taken along line 2—2 of FIG. 1. Arrow 22 represents the centerline of the threadline (not shown) emerging from orifice 21, with the direction of flow being the same as the direction of arrow 22. Arrow 23 represents the orientation of a gaseous stream relative to arrow 22, with the direction of flow being in the same direction as arrow 23. Angle 24 formed by arrows 21 and 22 is the vertical angle of incidence. The vertical angle of incidence of any gaseous source generally will be no more than about 90°. Preferably, the vertical angle of incidence will be no more than about 60°, and most preferably no more than about 45°. As already noted, the foregoing requirement and preferred values for the vertical angle of incidence refer to absolute values when any given gaseous source involves more than one gaseous stream.

As already noted, macro scale turbulence is in part a function of the orientation of the gaseous source. From a consideration of FIGS. 1 and 2, one having ordinary skill in the art should appreciate that the horizontal angle of incidence will have the least effect on macro scale turbulence (i.e., web uniformity) when such angle is about 90°. Similarly, the vertical angle of incidence will have the least effect on macro scale turbulence when it is about 0°. As the horizontal angle of incidence deviates from 90° and/or the vertical angle of incidence increases above 0°, macro scale turbulence to some extent can be reduced by decreasing the gaseous source velocity.

In addition, it should be apparent that the macro scale turbulence of any gaseous source needs to be carefully controlled along the entire width of the threadline curtain. In general, such control in part is accomplished through the use of known manifold designs. For example, a manifold can be used which has a gradually reduced cross-section. In addition, a combination of honeycomb sections with screens or sintered, porous metal baffles effectively destroy the undesired large scale turbulent eddy currents which may otherwise be formed.

As the controlled high velocity gaseous source exits the opening of a duct or manifold, it entrains the surrounding ambient air and its velocity is decreased as the distance from such opening increases. During the momentum transfer between the high velocity gaseous source and the ambient air, the size of turbulent eddies increases. Small scale turbulent eddies help entangle the fibers at an early stage near the opening from which the gaseous source emerges, but eddies which grow at distances of around 50 cm or more from such opening adversely affect web uniformity by the formation of heavy and light basis weight areas in the web. Thus, it is important that formation distances be kept within the limits specified herein. Moreover, some ambient air entrainment is essential for keeping large scale eddy currents at a minimum.

Threadline Viscosity

As noted hereinbefore, the primary gaseous source has a relative humidity of from about 70 to 100 percent. More preferably, such gaseous source will have a relative humidity of from about 60 to about 100 percent. Most preferably, the relative humidity of the primary gaseous source will be in the range of from about 80 to about 100 percent.

It has been found that the presence of water droplets in the humidified gaseous source can have adverse effects on threadline and fiber formation, particular with respect to the formation of shot. Consequently, it is preferred that any water droplets which may be present in the humidified gaseous source have diameters less than the diameters of the threadlines. Most preferably, the humidified gaseous stream will be essentially free of water droplets.

In practice, water droplets have been successfully removed from the humidified gaseous source through the use of an impingement separator. Additionally, it is helpful to heat all passageways through which the humidified gaseous source passes prior to impinging the threadlines. However, passage-way temperatures should be such that the temperature of the humidified gaseous source remains within acceptable limits as already described.

The temperature of the primary gaseous source typically will be in the range of from about 20° C. to about 100° C. Such temperature more preferably will be in the range of from about 40° C. to about 100° C., and most preferably from about 60° C. to about 90° C.

Figure 3:
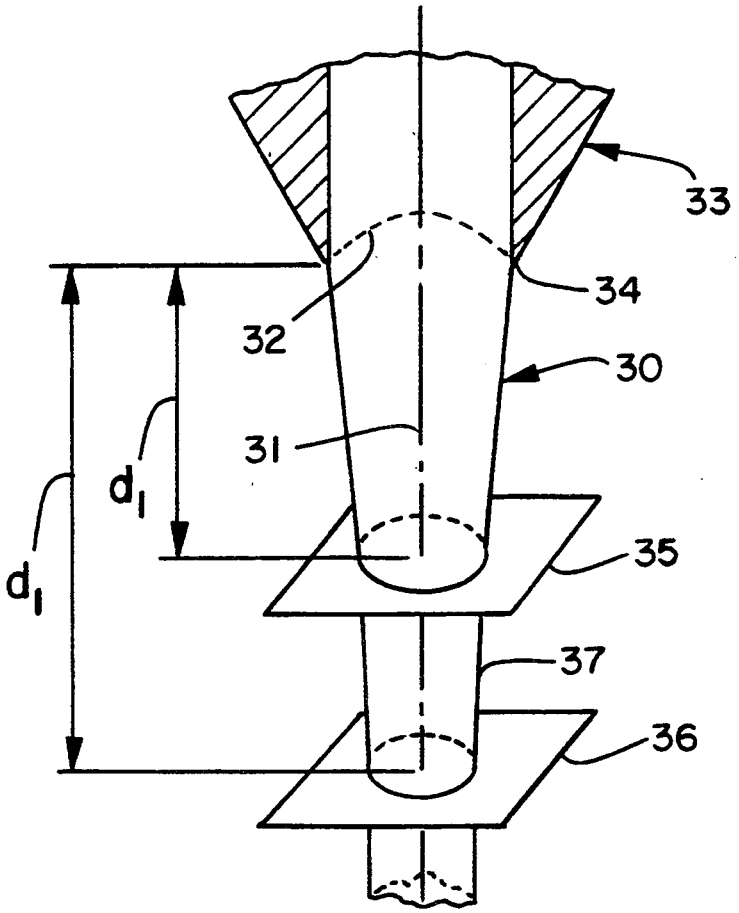
FIG. 3 is a perspective view of a portion of a poly(vinyl alcohol) threadline produced in accordance with the present invention.
Figure 4:
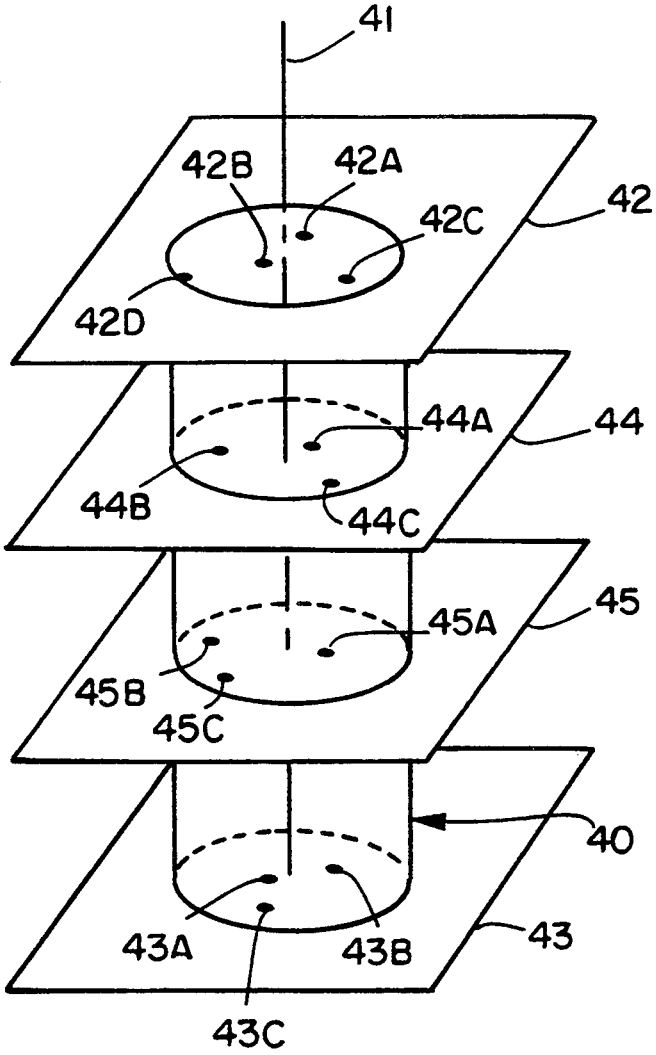
FIG. 4 is a perspective view of a portion of the threadline shown in FIG. 3.

The viscosity requirements perhaps are best understood with reference to FIGS. 3 and 4. FIG. 3 is a perspective view of a portion of threadline 30 having longitudinal axis 31 as it emerges from orifice 32 in die 33 (shown in partial cross-section) having face 34. Plane 35 is perpendicular to axis 31 and is at a distance $d_1$ from die face 34. Plane 36 also is perpendicular to axis 31 and is at a distance $d_2$ from die face 34 with $d_2$ being greater than $d_1$ (i.e., $d_2 > d_1$). Section 37 of threadline 30 lies between planes 35 and 36. Because threadline 30 is being attenuated, the diameter of the threadline decreases with increasing distance from the die. Consequently, section 37 of threadline 30 approximates an inverted truncated cone or, more properly, an inverted frustrum of a cone.

Section 37 of threadline 30 of FIG. 3 which is located between planes 35 and 36 of FIG. 3 is shown in perspective view in FIG. 4. In FIG. 4, threadline section 40 has axis 41 and is defined by upper plane 42 (i.e., plane 35 in FIG. 3), and lower plane 43 (i.e., plane 36 in FIG. 3). Both planes are perpendicular to axis 41 and are, therefore, parallel with each other. Additional planes 44 and 45 are shown, which planes also are perpendicular to axis 41 (or parallel with planes 42 and 43) and are at distances $d_3$ and $d_4$, respectively, from the face of the die which is not shown (i.e., face 34 of die 33 in FIG. 3). It will be remembered from FIG. 3 that upper plane 42 and lower plane 43 are at distances $d_1$ and $d_2$, respectively, from the face of the die. Thus, $d_1 < d_3 < d_4 < d_2$. $d_4 < d_2$. Points 42A, 42B, 42C, and 42D lie in upper plane 42. Similarly, points 43A, 43B, and 43C lie in lower plane 43, points 44A, 44B, and 44C lie in plane 44, and points 45A, 45B, and 45C lie in plane 45.

With reference to FIG. 4, uniformity of viscosity in the radial direction means that the viscosity of the threadline at any point lying in a plane perpendicular to axis 41 is approximately the same. That is, the viscosity of the threadline at points 42A, 42B, 42C, and 42D is essentially the same. Moreover, the viscosity at points 43A, 43B, and 43C is essentially the same, the viscosity at points 44A, 44B, and 44C is essentially the same, and the viscosity at points 45A, 45B, and 45C is essentially the same.

However, the viscosity of the threadline increases incrementally with increasing distance from the die. That is, the viscosity of the threadline at any of points 44A, 44B, and 44C, again with reference to FIG. 4, is greater than the viscosity at any of points 42A, 42B, 42C, and 42D. The viscosity at any of points 45A, 45B, and 45C in turn is greater than the viscosity at any of points 44A, 44B, and 44C. Finally, the viscosity at any of points 43A, 43B, and 43C is greater than the viscosity at any of points 45A, 45B, and 45C.

All of the foregoing viscosity relationships can be expressed mathematically as follows, in which $\beta_{Pn}$ is the viscosity at point n:

$$\eta_{P43A} \approx \eta_{P43B} \approx \eta_{P43C} > \eta_{P45A} \approx \eta_{P45B} \approx \eta_{P45C} > \eta_{P44A} \approx \eta_{p44B} \approx$$

$$\eta_{P44C} > \eta_{P42A} \approx \eta_{P42B} \approx \eta_{P42C} \approx \eta_{P42D}$$

The extent of the increase of viscosity with increasing distance form the die is critical over the distance from the die specified herein. However, the increase should not be so large as to contribute to fiber breakage or so small that the threadline does not solidify sufficiently before reaching the moving foraminous surface on which the nonwoven web is formed. The term "incrementally" is associated with the increase in viscosity to convey the concept that such increase is a slight or imperceptible increase from a given plane having a very small thickness to the next or adjacent plane downstream from the die. Thus, such change in viscosity can be considered to be the derivative dy/dx, where dy is the increase in viscosity resulting from an increase dx in distance from the die when such increase in distance approaches zero.

It is not possible, however, to measure the viscosity of the threadline at any given point, or to measure or estimate the concentration and temperature from which a viscosity could be calculated or estimated. Nevertheless, it has been determined empirically that the foregoing conditions for viscosity must exist when fibers having the required characteristics, including the absence of shot, desired fiber diameters, desired molecular orientation (attenuation), etc., are obtained. Significant deviations from such viscosity requirements result in shot, broken fibers, irregular web formation, and/or fibers having highly variable and irregular diameters.

Surprisingly, it has been found that fibers or particles can be comingled with the threadlines in a manner somewhat analogous to the known practice of coforming, referred to earlier. In this case, primary and secondary gaseous sources are employed, essentially as already described, with the fibers or particles being introduced into the secondary gaseous source. When two secondary gaseous streams are employed, which is preferred, the fibers or particles can be included in either or both of the secondary gaseous streams.

Alternatively, three gaseous sources can be employed in the preparation of a coformed web—a primary gaseous source, a secondary gaseous source, and a tertiary gaseous source. This is the first exception, mentioned earlier, to the general avoidance of the use of a subsequent gaseous source, i.e., a gaseous source in addition to primary and secondary gaseous sources. In this case, the fibers or particles typically are included in the tertiary gaseous source, in which case a single tertiary gaseous stream usually is sufficient. When a fiber- or particle-carrying tertiary gaseous source is employed, the tertiary gaseous source usually will be at ambient temperature and have a velocity of from about 5 to about 15 m/s. While a heated gaseous source can be used, care must be taken to avoid softening the fibers to an extent which causes excessive bonding of the poly(vinyl alcohol) fibers to each other and/or to the fibers or particles with which they are intermingled.

The second exception relates to the formation of a nonwoven web from continuous fibers. In this case, the use of three gaseous sources contributes to the control of turbulence and, consequently, to improved web uniformity. The characteristics of the three gaseous sources are described briefly below.

The primary gaseous source typically will have a relative humidity of from about 70 to 100 percent and a temperature of from about 20° C. to about 100° C., a horizontal angle of incidence of from about 70° to about 110°, and a vertical angle of incidence of no more than about 90°. The velocity of the primary gaseous source in general will be no more than about 45 m/s. Such velocity preferably will be in the range of from about 5 to about 15 m/s. The function of the primary gaseous source is to provide the conditions which are necessary to permit the required threadline viscosity increases as described hereinbefore. Thus, the primary gaseous source in this case functions as a conditioning source.

The secondary gaseous source in general will have a temperature of from about 20° C. to about 100° C., a horizontal angle of incidence of from about 70° to about 110°, and a vertical angle of incidence of no more than about 90°. The velocity of the secondary gaseous source typically will be no more than about 45 m/s. The velocity of the secondary gaseous source preferably will be in the range of from about 5 to about 15 m/s. The secondary gaseous source serves primarily to partially dry the threadlines, although a small degree of attenuation also may take place.

Finally, the tertiary gaseous source usually will have a lower temperature and a higher velocity than either the primary gaseous source or the secondary gaseous source. Thus, the tertiary gaseous source functions primarily to attenuate and more fully dry the fibers. In general, the tertiary gaseous source will have a temperature in the range of from about 10° C. to about 50° C. The velocity of the tertiary gaseous source generally can range from about 30 to about 245 m/s. In addition, such gaseous source will have a horizontal angle of incidence of from about 70° to about 110° and a vertical angle of incidence of no more than about 90°.

The present invention is further illustrated by the examples which follow. Such examples, however, are not to be construed as in any way limiting either the spirit or scope of the present invention.

EXAMPLE 1

Figure 5:
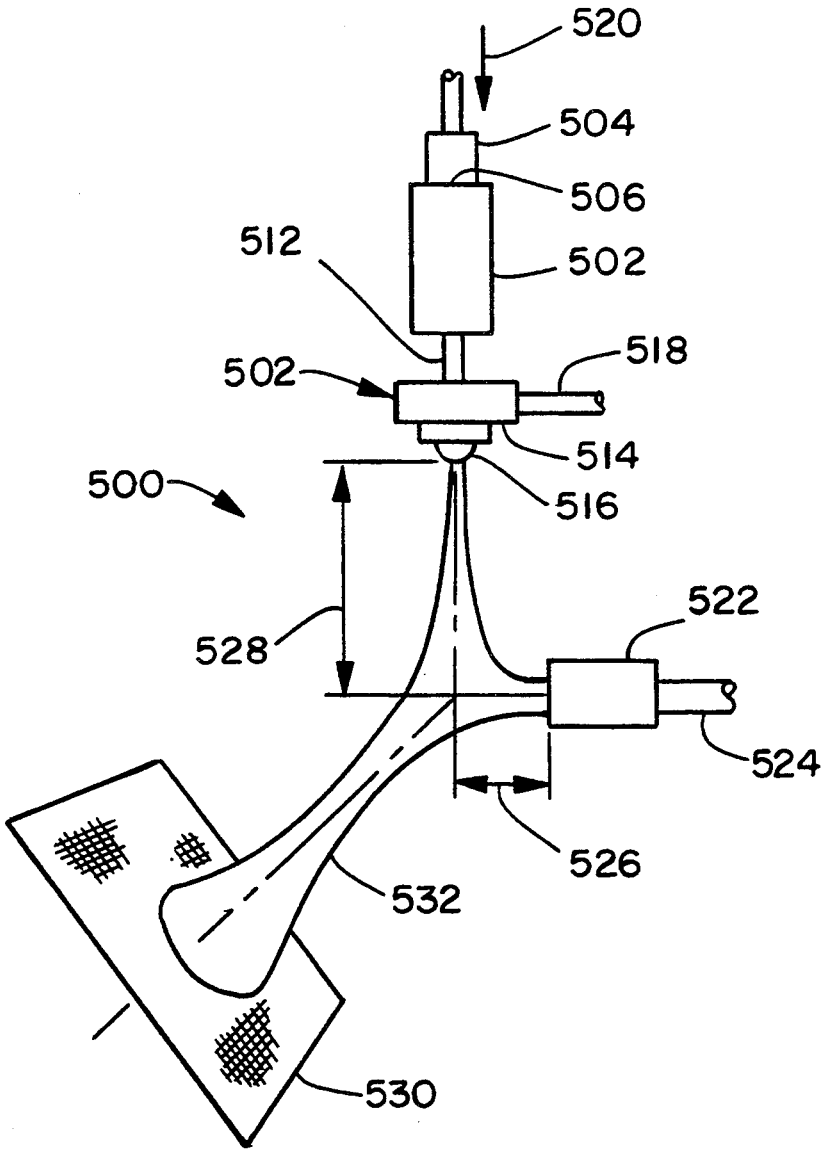
FIG. 5 is a schematic representation of one embodiment of the present invention.

As a simple screening method, fibers were formed by means of a bench-scale apparatus, a schematic representation of which is shown in FIG. 5. Referring to FIG. 5, apparatus 500 consisted of cylindrical steel reservoir 502 having a capacity of about 60 $cm^3$. The reservoir was enclosed by an electrically heated steel jacket. The temperature of the reservoir was thermostatically controlled by means of a feedback thermocouple (not shown) mounted in the body of the reservoir. Movable piston 504 was located in upper end 506 of reservoir 502. Extrusion die assembly 508 was mounted in lower end 510 of reservoir 502 by means of electrically heated, thermostatically controlled connecting pipe 512. Extrusion die assembly 508 consisted of manifold 514 and die tip 516. Manifold 514 was connected to a primary gaseous source (not shown) by means of conduit 518. Die tip 516 had a single extrusion orifice (not shown), surrounded by a circular 0.075-inch (1.9-mm) gap (not shown). The extrusion orifice had a diameter of 0.016 inch (0.41 mm) and a length of 0.060 inch (1.5 mm). A second thermocouple (not shown) was mounted near die tip 516. Extrusion of the poly(vinyl alcohol) solution was accomplished by the downward motion, shown by arrow 520, of piston 504 in reservoir 502, piston 504 being driven by a constant-speed electric motor (not shown). The extruded threadline (not shown) was surrounded and attenuated by a cylindrical, humidified primary air stream exiting said circular gap. Attenuating air pressures typically were of the order of 0–8 psig. The wet threadlines then were dried by a secondary air stream which exited essentially normal to the threadline from manifold 522 connected by conduit 524 to a secondary gaseous source (not shown). Distance 526 of the secondary source manifold opening from the descending threadline was about 5 cm. Distance 528 of the axis of the secondary gaseous source from the die tip also was about 5 cm. The dried threadline was collected on foraminous screen 530 under which a vacuum box (not shown) was located. Foraminous screen 530 was 35–40 cm from the opening of manifold 522 from which the secondary gaseous source exited. Region 532 generally represents the combination of primary gaseous source, secondary gaseous source, and threadline flows.

The poly(vinyl alcohol) solution was prepared by mixing 20 parts of polymer, 80 parts of water, and 2 parts of a polyethylene glycol, PEG 400 (Union Carbide Corporation) for about five hours at 90°–110° C. in a glass reaction kettle. The resulting solution was deaerated before use.

Extrusion of a poly(vinyl alcohol) solution was carried out at about 70° C. The primary gaseous source typically was heated compressed air humidified by the addition of atomized water droplets through the use of an "Oil Fog" lubricator or steam, although the latter most often was used. The relative humidity of the primary gaseous source was greater than 90 percent. The temperature of the primary gaseous source was approximately 55 ° C. The secondary gaseous source was compressed air heated to a temperature of 260°–370° C. The exit velocities of the primary and secondary gaseous sources were about 800 feet per second (about 244 meters per second) and 500 feet per second (about 152 meters per second), respectively.

A number of different vinyl alcohol polymers were employed in order to evaluate the effects of molecular weight and degree of hydrolysis in the method of the present invention. All of the polymers were obtained from Air Products and Chemicals, Inc., Polymer Chemicals Division, Allentown, Pa., under the Airvol® trademark. The polymers and their properties as reported by the manufacturer are summarized in Table 1-1. The viscosity reported in the table is for a 4 percent by weight aqueous solution at 20° C.

TABLE 1-1

| Web No. | PVOH No. | Poly(vinyl alcohol) Characteristics: Percent Hydrolysis | Mol. Wt. | Viscosity (cps) |
|---|---|---|---|---|
| 1 | 103 | 98.0–98.8 | 13,000–23,000 | 3.2–4.2 |
| 2 | 107 | 98.0–98.8 | 31,000–50,000 | 5.4–6.5 |
| 3 | 325 | 98.0–98.8 | 85,000–146,000 | 26–30 |

TABLE 1-1-continued

| Web No. | PVOH No. | Poly(vinyl alcohol) Characteristics: Percent Hydrolysis | Mol. Wt. | Viscosity (cps) |
|---|---|---|---|---|
| 4 | 350 | 98.0–98.8 | 124,000–186,000 | 55–65 |
| 5 | 203 | 87.0–89.0 | 13,000–23,000 | 3–4 |
| 6 | 205 | 87.0–89.0 | 31,000–50,000 | 5–6 |
| 7 | 523 | 87.0–89.0 | 85,000–146,000 | 22–26 |
| 8 | 540 | 87.0–89.0 | 124,000–186,000 | 40–50 |

Before carrying out fiber diameter and tensile property measurements, some qualitative observations regarding fiber and web formation were made. These are summarized in Table 1-2.

TABLE 1-2

| Airvol® Number | Qualitative Observations of Fiber and Web Characteristics: Texture | Strength |
|---|---|---|
| 103 | Fluffy, fine, soft | Very low |
| 107 | Fine, soft | Low |
| 325 | Slightly coarse | Medium high |
| 350 | Shotty, very coarse | High |
| 203 | Melted into screen | Very low, brittle |
| 205 | Fluffy, fine, soft | Medium to med.-low |
| 523 | Slightly coarse | Very High |
| 540 | Slightly coarse | Very High |

The basis weights of webs 3, 4, 7, and 8 were determined from 1 inch by 6 inch (2.5×15.2 cm) strips cut for various test procedures. The results obtained are summarized in table 1-3; each value, reported in g/m², is the average of measurements of samples from three or four different locations (actual sample weights are not reported). The measurements were made in accordance with Federal Standard 191A, Method 5041. In Table 1-3, "Std." means the standard deviation.

TABLE 1-3

| Summary of Nonwoven Web Basis Weights from 1 Inch by 6 Inch Strips (2.5 × 15.2 cm): Web Number | Average | Std. |
|---|---|---|
| 3 | 5.17 | 0.97 |
| 4 | 14.27 | 1.31 |
| 7 | 10.91 | 0.56 |
| 8 | 24.93 | 0.99 |

Fiber size distribution measurements were made on six of the webs, i.e., webs 2, 3, 4, 6, 7, and 8. This involved measuring the diameter of each fiber which crossed an arbitrary straight line drawn on a typical scanning electron micrograph and typically required measuring the diameters of 60–100 fibers. The results of such measurements are summarized in Table 1-4.

TABLE 1-4

| Fiber Diameter (μm) | Fiber Diameter Distribution: Frequency Web 2 | Web 3 | Web 4 | Web 6 | Web 7 | Web 8 |
|---|---|---|---|---|---|---|
| 0.13 | 0 | 0 | 0 | 0 | 0 | 0 |
| 0.16 | 1 | 2 | 0 | 2 | 0 | 0 |
| 0.20 | 2 | 7 | 0 | 1 | 0 | 0 |
| 0.25 | 11 | 10 | 0 | 12 | 0 | 0 |
| 0.32 | 11 | 13 | 0 | 9 | 0 | 0 |
| 0.40 | 20 | 14 | 0 | 20 | 0 | 0 |
| 0.50 | 7 | 8 | 1 | 8 | 0 | 0 |
| 0.63 | 11 | 14 | 1 | 10 | 0 | 0 |
| 0.79 | 22 | 15 | 0 | 22 | 0 | 0 |
| 1.00 | 10 | 4 | 3 | 12 | 4 | 1 |

TABLE 1-4-continued

| Fiber Diameter (μm) | Fiber Diameter Distribution Frequency Web 2 | Web 3 | Web 4 | Web 6 | Web 7 | Web 8 |
|---|---|---|---|---|---|---|
| 1.26 | 2 | 3 | 6 | 1 | 3 | 0 |
| 1.58 | 2 | 3 | 14 | 1 | 9 | 1 |
| 2.00 | 1 | 3 | 18 | 2 | 8 | 2 |
| 2.51 | 0 | 1 | 19 | 0 | 6 | 1 |
| 3.16 | 0 | 1 | 13 | 0 | 5 | 0 |
| 3.98 | 0 | 0 | 14 | 0 | 7 | 1 |
| 5.01 | 0 | 2 | 9 | 0 | 16 | 3 |
| 6.31 | 0 | 0 | 1 | 0 | 24 | 3 |
| 7.94 | 0 | 0 | 1 | 0 | 10 | 5 |
| 10.00 | 0 | 0 | 0 | 0 | 2 | 1 |
| 12.59 | 0 | 0 | 0 | 0 | 4 | 2 |
| 15.85 | 0 | 0 | 0 | 0 | 1 | 11 |
| 19.95 | 0 | 0 | 0 | 0 | 1 | 25 |
| 25.12 | 0 | 0 | 0 | 0 | 0 | 26 |
| 31.62 | 0 | 0 | 0 | 0 | 0 | 15 |
| 39.81 | 0 | 0 | 0 | 0 | 0 | 3 |
| Ave. | 0.53 | 0.65 | 2.44 | 0.54 | 4.62 | 18.19 |
| Std. | 0.28 | 0.70 | 1.18 | 0.30 | 2.97 | 7.99 |

Figure 6:
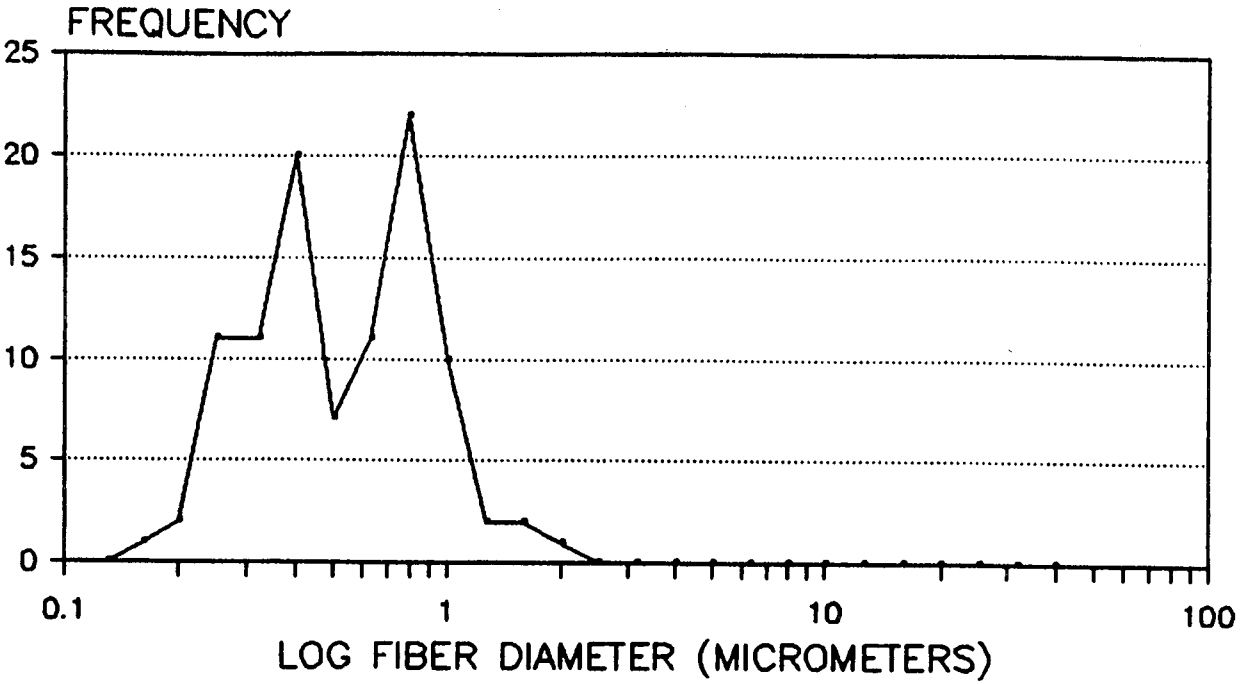
FIGS. 6–15 are plots of frequency of occurrence versus the log of fiber diameter in micrometers of a number of nonwoven webs produced in accordance with the present invention.
Figure 7:
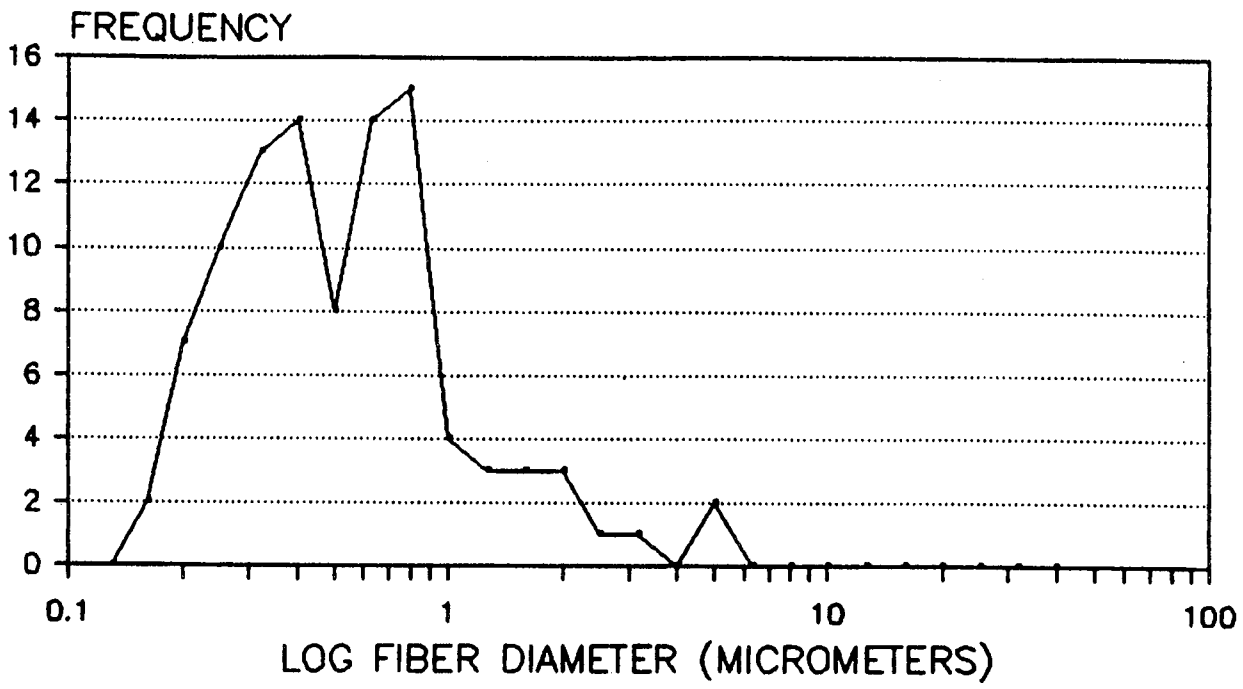
Figure 8:
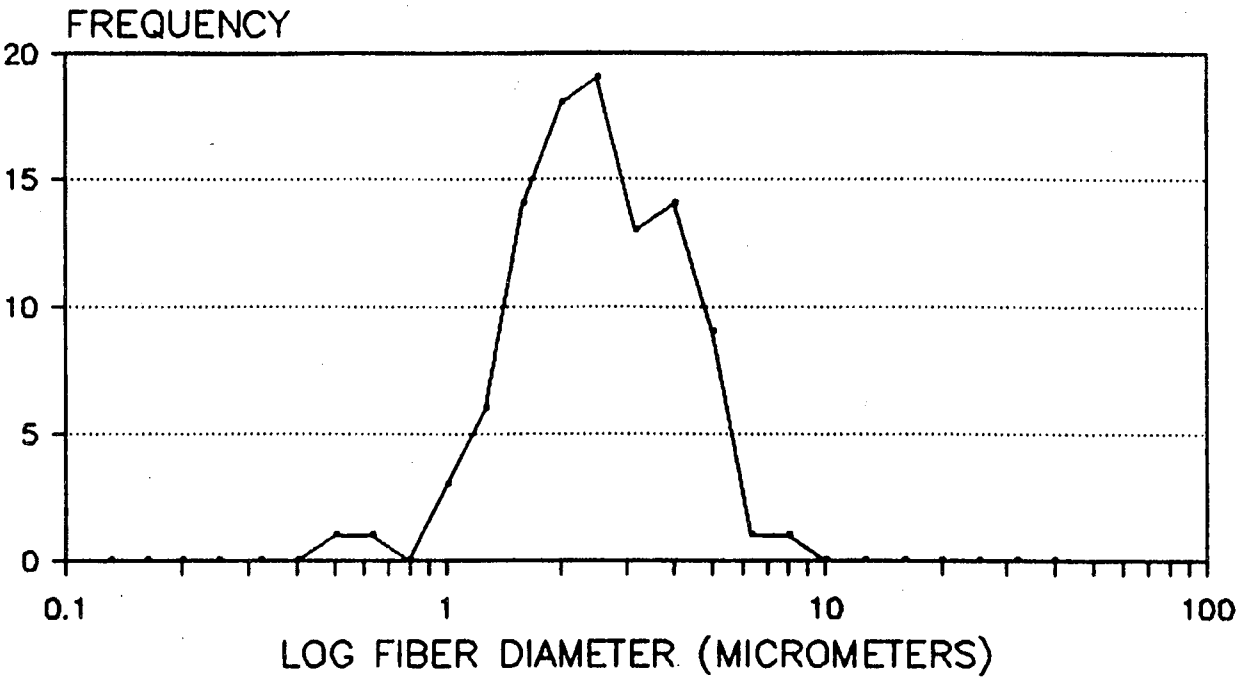
Figure 9:
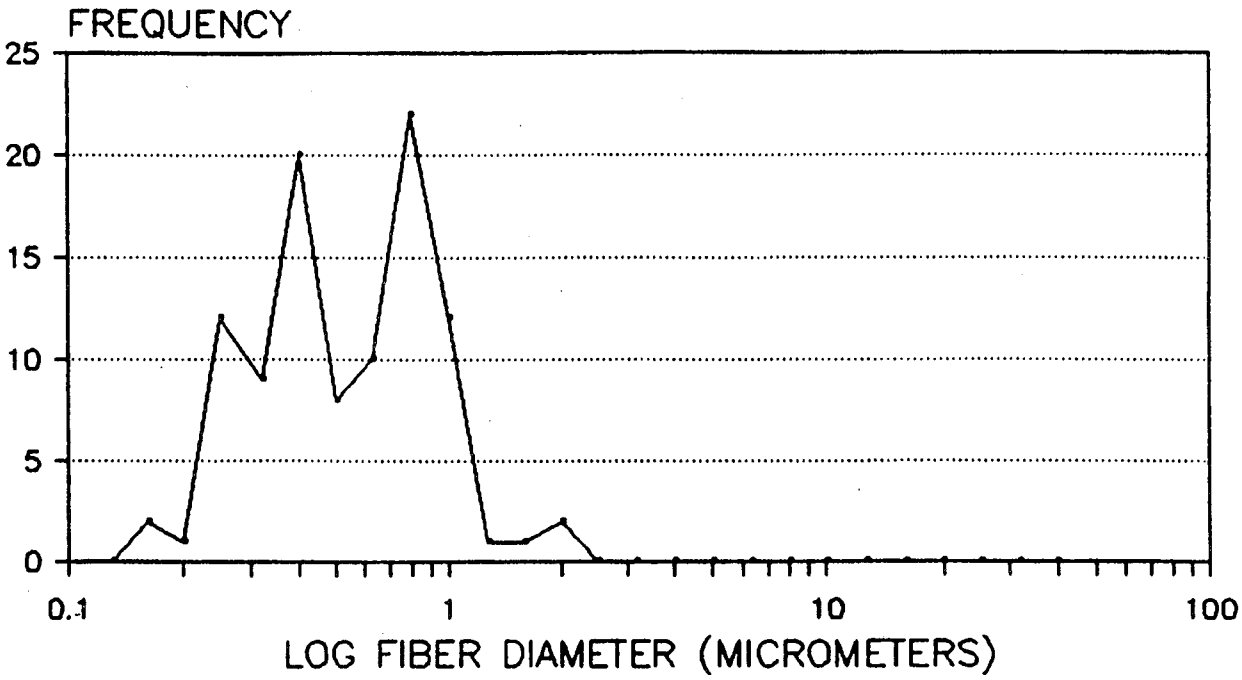
Figure 10:
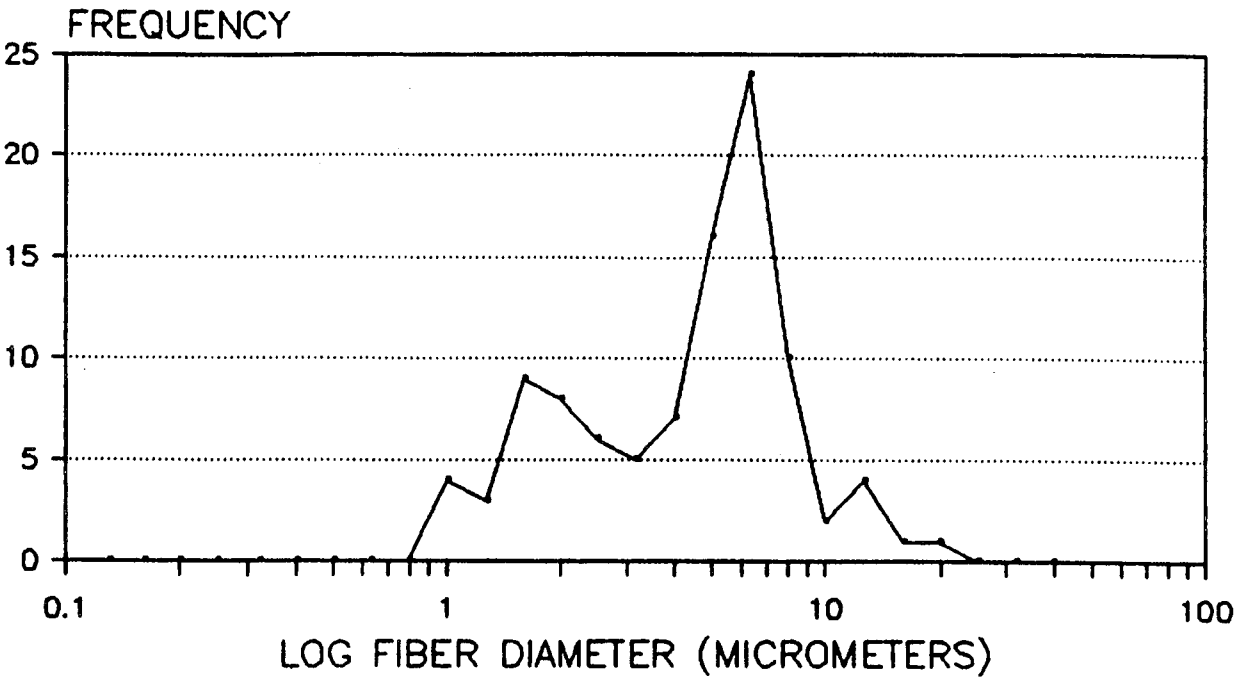
Figure 11:
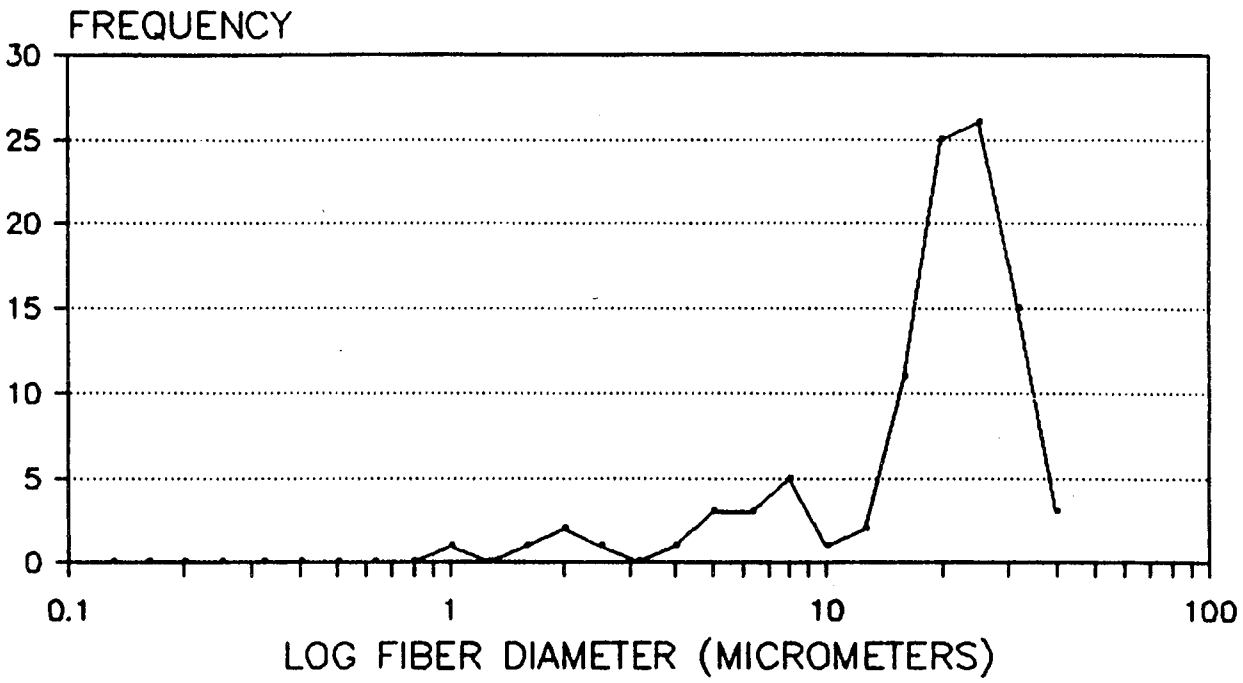

To aid in the visualization of the fiber diameter frequencies shown in Table 1-4, the data were plotted as frequency versus fiber diameter in μm. Such plots are shown in FIGS. 6–11, respectively. That is, the plot for the web 2 measurements is shown in FIG. 6, the plot for the web 3 measurements is shown in FIG. 7, and so on.

The tensile properties of webs 3, 4, 7, and 8 were measured in accordance with Federal Standard 191A, Method 5102, for strip tensile properties, after conditioning in a controlled humidity chamber (70 percent relative humidity) overnight. The strip tensile procedure gave results for peak load, percent elongation, and energy, all of which are reported in Table 1-5. The values given have been normalized to allow for different web basis weights. The actual data have not been included to conserve space.

TABLE 1-5

| Web No. | Strip Tensile Properties Peak Load (meters) | Percent Elongation | Peak Energy (meters) |
|---|---|---|---|
| 3 | 1244 | 29.0 | 775 |
| 4 | 1035 | 36.9 | 824 |
| 7 | 1941 | 102.4 | 4133 |
| 8 | 1833 | 74.0 | 2991 |

It should be recognized that, given the fact that only a single threadline was produced and in view of the manner of forming the web, little significance can be attached to the results summarized in Tables 1-3 and 1-5. A meaningful evaluation of fiber and web properties can be conducted only with a web formed from a plurality of threadlines, as is described in Example 2.

EXAMPLE 2

Several of the Airvol® poly(vinyl alcohols) employed in Example 1 were used to prepare nonwoven webs on an apparatus having a six-inch (15.2-cm) wide die having 180 orifices (30 orifices per inch or about 11.8 orifices per cm). Each orifice had a diameter of 0.46 mm. The die was constructed essentially as described in U.S. Pat. Nos. 3,755,527, 3,795,571, and 3,849,241, each of which is incorporated herein by reference. The primary gaseous source was divided into two streams, the exits of which were located parallel with and closely adjacent to the row of extrusion orifices. Each primary gaseous stream exit was about 0.38 mm in width. The ducts leading to the two primary gaseous stream exits were at an angle of 30° from the vertical, i.e., the plane in which the centers of the extrusion orifices were located. Thus, the vertical angles of incidence for the two primary gaseous streams were 30° and −30°, respectively; the absolute value of the vertical angle of incidence for each of the two primary gaseous streams was 30°. The horizontal angle of incidence for each primary gaseous stream was 90°.

The secondary gaseous source also was divided into two secondary gaseous streams. The first secondary gaseous stream was introduced on the back side of the threadline curtain. The vertical angle of incidence for the first secondary gaseous stream was −30°; the horizontal angle of incidence was 90°. The exit of the first secondary gaseous stream was located about 5 cm below the die tip and about 2.5 cm from the threadline curtain.

The second secondary gaseous stream was introduced on the front side of the threadline curtain. The vertical angle of incidence for the second secondary gaseous stream was about 0° and the horizontal angle of incidence was 90°. Thus, the second secondary gaseous stream exited the secondary gaseous stream conduit approximately parallel with the threadline curtain. The exit of the second secondary gaseous stream was located about 5 cm below the die tip and about 10 cm from the threadline curtain. The moving foraminous surface (a rotating wire drum) was located roughly 22–76 cm below the secondary gaseous source exits which were approximately equal distances below the die tip. A vacuum of 2–6 inches (0.005–0.015 atm) water was maintained under the wire.

The poly(vinyl alcohol) solution was prepared by heating 25 parts of polymer and 75 parts of water in a two-liter Buchi autoclave at 95°–100° C. with stirring at 200–1,000 rpm Optionally, PEG 400 was included in an amount ranging from about 10 percent to about 50 percent, based on the amount of poly (vinyl alcohol ) employed.

The solution was pumped by means of a Zenith metering pump to the die through a transfer line heated at about 82° C. The solution was extruded at about 82° C. The primary gaseous source was pure steam at a temperature of approximately 99°–105° C. and a pressure of 20–50 inches water (0.05–0.12 atm). The secondary gaseous source was compressed air heated to a temperature of 260°–316° C.; the flow rate was 90–130 cfm (42.5–61.4 liters per second). The exit velocities of the primary and secondary gaseous sources were about 800 feet per second (about 244 meters per second) and 500 feet per second (about 152 meters per second), respectively. The die tip temperature was maintained at 82° C. and the extrusion rate was 0.19–0.28 g per minute per orifice.

Four different solutions involving three of the vinyl alcohol polymers employed in Example 1 were extruded to form nonwoven webs. These solutions are summarized in Table 2-1.

TABLE 2-1

| Solution Number | Summary of Solutions Extruded Airvol® Number | Solution Composition (Parts) PVOH | Water | PEG-400 |
|---|---|---|---|---|
| 1 | 125 | 25 | 75 | — |
| 2 | 125 | 25 | 72.5 | 2.5 |
| 3 | 523 | 25 | 75 | — |

TABLE 2-1-continued

| Summary of Solutions Extruded | | | | |
|---|---|---|---|---|
| Solution Number | Airvol ® Number | Solution Composition (Parts) PVOH | Water | PEG-400 |
| 4 | 205 | 40 | 40 | 20 |

The basis weight target for each web produced was either 23.7 g/m$^2$ or 33.4 g/m$^2$ (0.7 oz/yd$^2$ or 1.0 oz/yd$^2$, respectively). Actual basis weights were determined from strips cut for various test procedures. Since not all tests required the same sample size, three different basis weight determinations are reported. The results obtained are summarized in Tables 2-2, 2-3, and 2-4; each value, reported in g/m$^2$, is the average of measurements of samples from five different locations (actual sample weights are not reported). Sample sizes are noted in the table headings. The measurements were made in accordance with Federal Standard 191A, Method 5041. Two sets of strips were cut, one set with the longer dimension in the machine direction, and the other set with the longer dimension in the cross direction. In the tables, "%COV" means the percent coefficient of variation which is equal to 100 times the quotient of the standard deviation divided by the average value. In addition, the web number indicates the solution from which the web was prepared.

TABLE 2-2

| Summary of Nonwoven Web Basis Weights from 1 Inch by 6 Inch Strips (2.5 × 15.2 cm) | | | | |
|---|---|---|---|---|
| Web | MD | | CD | |
| Number | Average | % COV | Average | % COV |
| 1 | 20.87 | 4.38 | 21.55 | 4.04 |
| 2 | 39.11 | 8.47 | 36.01 | 5.90 |
| 3 | 18.50 | 4.52 | 20.00 | 6.12 |
| 4 | 34.67 | 7.17 | 30.95 | 3.15 |

TABLE 2-3

| Summary of Nonwoven Web Basis Weights from 1 Inch by 4 Inch Strips (2.5 × 10.2 cm) | | | | |
|---|---|---|---|---|
| Web | MD | | CD | |
| Number | Average | % COV | Average | % COV |
| 1 | 20.00 | 2.33 | 20.00 | 1.07 |
| 2 | 36.97 | 12.7 | 38.29 | 4.26 |
| 3 | 20.85 | 3.83 | 19.07 | 5.19 |
| 4 | 29.30 | 6.63 | 36.58 | 2.90 |

TABLE 2-4

| Summary of Nonwoven Web Basis Weights Over 13.468 in$^2$ (86.89 cm$^2$) | | | | |
|---|---|---|---|---|
| Web | MD | | CD | |
| Number | Average | % COV | Average | % COV |
| 1 | 18.94 | 10.5 | 20.39 | 3.03 |
| 2 | 37.98 | 5.56 | 37.33 | 12.4 |
| 3 | 20.07 | 4.33 | 20.12 | 8.15 |
| 4 | 36.18 | 4.81 | 34.16 | 4.77 |

Fiber size distribution measurements were made on each of webs 1 to 4 as described in Example 1. The results of such measurements are summarized in Table 2-5.

TABLE 2-5

| Fiber Diameter Distribution | | | | |
|---|---|---|---|---|
| Fiber Diameter (μm) | Frequency Web 1 | Web 2 | Web 3 | Web 4 |
| 0.30 | 0 | 0 | 0 | 0 |
| 0.37 | 0 | 0 | 2 | 0 |
| 0.45 | 0 | 0 | 1 | 0 |
| 0.55 | 0 | 0 | 1 | 0 |
| 0.67 | 0 | 1 | 7 | 3 |
| 0.82 | 1 | 3 | 1 | 3 |
| 1.00 | 0 | 6 | 7 | 5 |
| 1.22 | 0 | 8 | 5 | 10 |
| 1.49 | 0 | 3 | 8 | 7 |
| 1.82 | 0 | 1 | 4 | 7 |
| 2.23 | 0 | 7 | 6 | 3 |
| 2.72 | 2 | 6 | 7 | 4 |
| 3.32 | 5 | 12 | 1 | 3 |
| 4.06 | 8 | 4 | 2 | 3 |
| 4.95 | 9 | 5 | 4 | 3 |
| 6.05 | 17 | 2 | 3 | 2 |
| 7.39 | 13 | 2 | 1 | 1 |
| 9.03 | 5 | 0 | 0 | 4 |
| 11.02 | 0 | 0 | 0 | 1 |
| 13.46 | 0 | 0 | 0 | 0 |
| Ave. | 5.2 | 2.5 | 1.9 | 2.5 |
| Std. | 1.7 | 1.5 | 1.5 | 2.2 |

Figure 12:
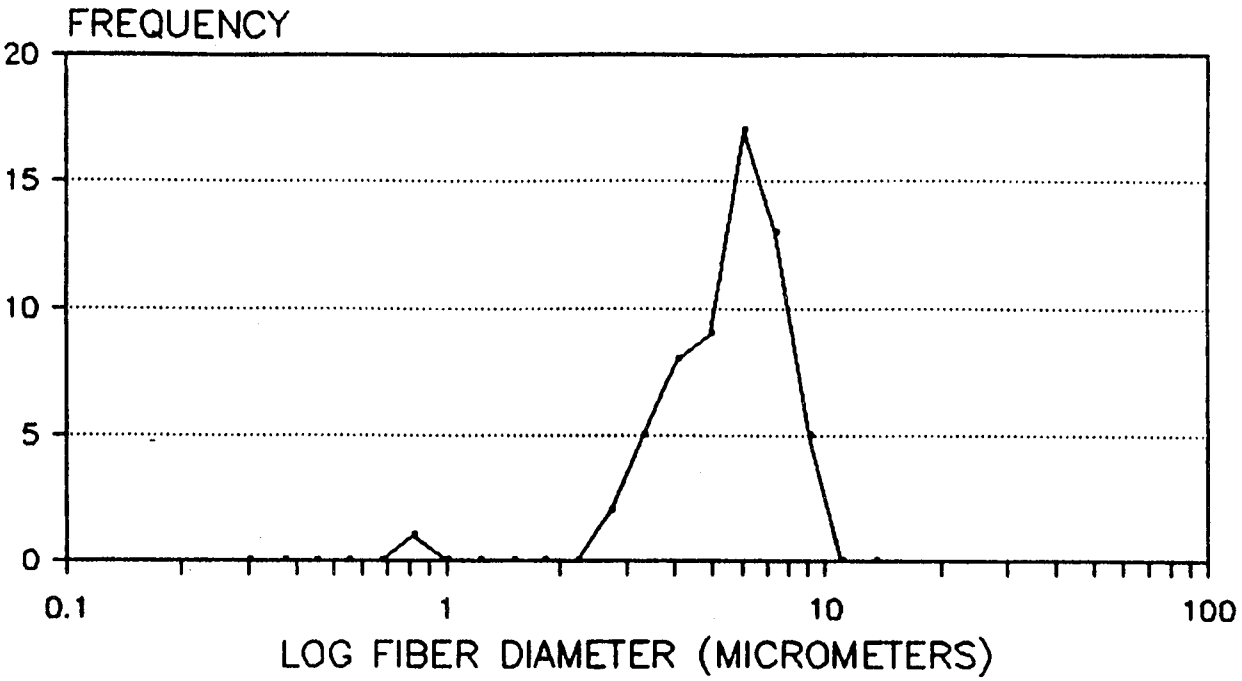
Figure 13:
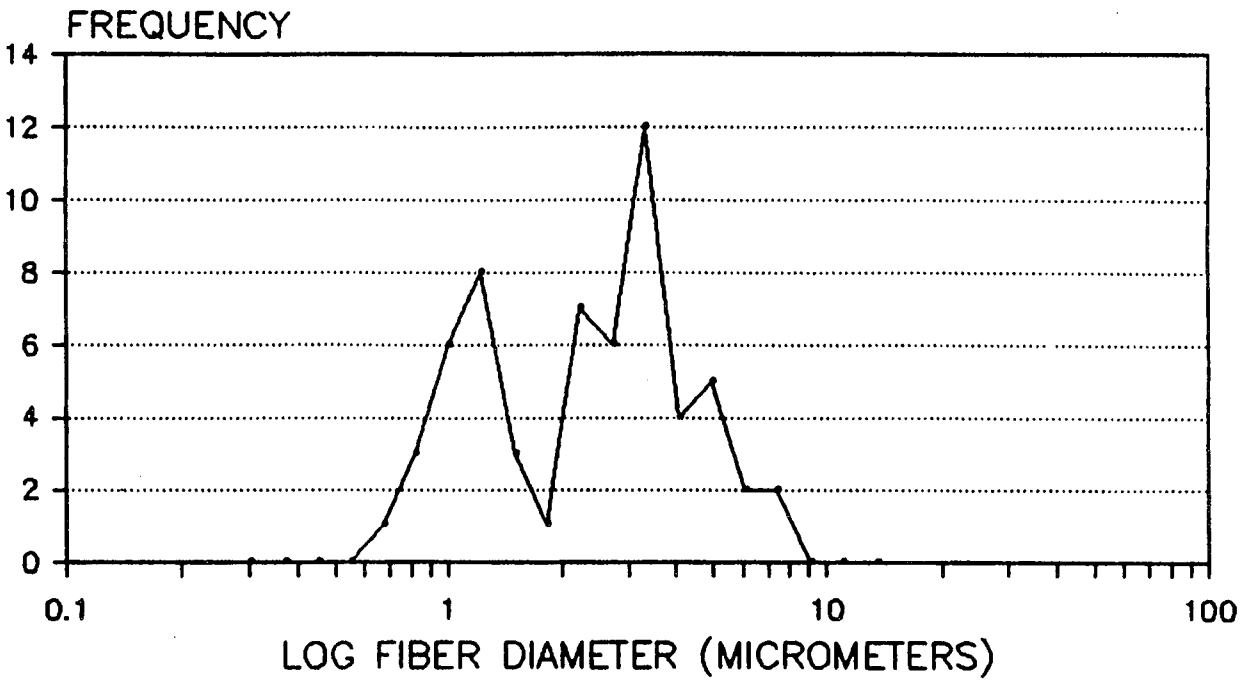
Figure 14:
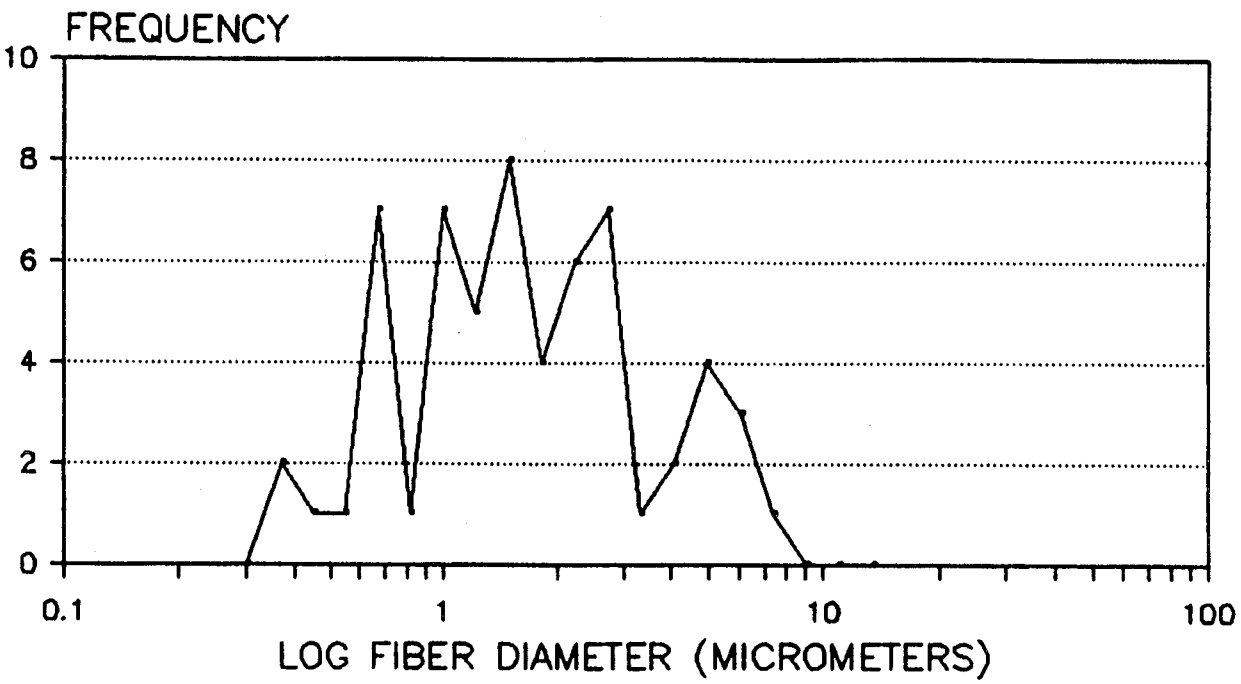
Figure 15:
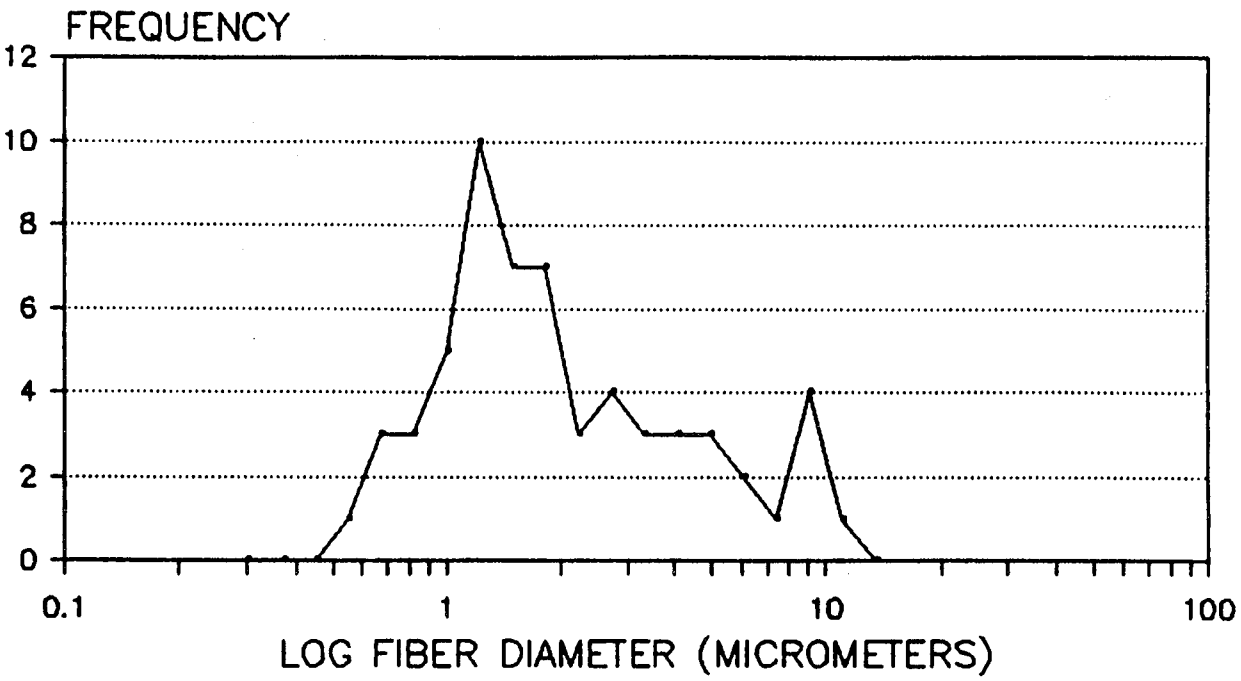

As was done in Example 1, the data from Table 2-5 were plotted as frequency versus fiber diameter in μm to aid in the visualization of the fiber diameter frequencies. Such plots are shown in FIBS. 12–15, respectively. That is, the plot for the web 1 measurements is shown in FIG. 12, the plot for the web 2 measurements is shown in FIG. 13, and so on.

The tensile properties of the nonwoven webs obtained were measured in accordance with standard test procedures. The measurements and test procedures are summarized in Table 2-6. The strip tensile procedure gave results for peak load, percent elongation, and energy, all of which are reported separately.

TABLE 2-6

| Summary of Web Measurements and Test Procedures | |
|---|---|
| Measurement | Test Procedure |
| Strip tensile | Federal Standard 191A, Method 5102 |
| Zero span | Federal Standard 191A, Method 5000 |
| Trap tear | ASTM Method D1117-14 |

The tensile characteristics of the nonwoven webs obtained are summarized in Tables 2-7 to 2-11, which follow. All values reported have been normalized to allow for differences in basis weights. For convenience, actual measurement data have not been reported.

TABLE 2-7

| Summary of Peak Load Results | | | |
|---|---|---|---|
| Web Number | MD Peak Load (meters) | CD Peak Load (meters) | Average (meters) |
| 1 | 1115 | 834 | 975 |
| 2 | 692 | 650 | 671 |
| 3 | 1364 | 1468 | 1416 |
| 4 | 322 | 231 | 277 |

TABLE 2-8

| Summary of Percent Elongation Results | | | |
|---|---|---|---|
| Web Number | MD Percent Elongation | CD Percent Elongation | Average |
| 1 | 19.94 | 23.76 | 21.85 |

TABLE 2-8-continued

| Summary of Percent Elongation Results | | | |
|---|---|---|---|
| Web Number | MD Percent Elongation | CD Percent Elongation | Average |
| 2 | 15.67 | 18.29 | 16.98 |
| 3 | 8.78 | 13.45 | 11.12 |
| 4 | 35.84 | 58.21 | 47.02 |

TABLE 2-9

| Summary of Energy Results | | | |
|---|---|---|---|
| Web Number | MD Energy (meters) | CD Energy (meters) | Average (meters) |
| 1 | 506 | 447 | 477 |
| 2 | 231 | 245 | 238 |
| 3 | 263 | 465 | 364 |
| 4 | 241 | 257 | 249 |

TABLE 2-10

| Summary of Zero Span Results | | | |
|---|---|---|---|
| Web Number | MD Zero Span (meters) | CD Zero Span meters) | Average (meters) |
| 1 | 1410 | 1230 | 1320 |
| 2 | 956 | 882 | 919 |
| 3 | 2063 | 2003 | 2033 |
| 4 | 532 | 323 | 323 |

TABLE 2-11

| Summary of Trap Tear Results | | | |
|---|---|---|---|
| Web Number | MD Trap Tear (sq. m) | CD Trap Tear (sq. m) | Average (sq. m) |
| 1 | 3.71 | 2.76 | 3.24 |
| 2 | 1.81 | 1.37 | 1.59 |
| 3 | 3.6 | 2.39 | 3.00 |
| 4 | 5.16 | 3.04 | 4.10 |

Figure 16:
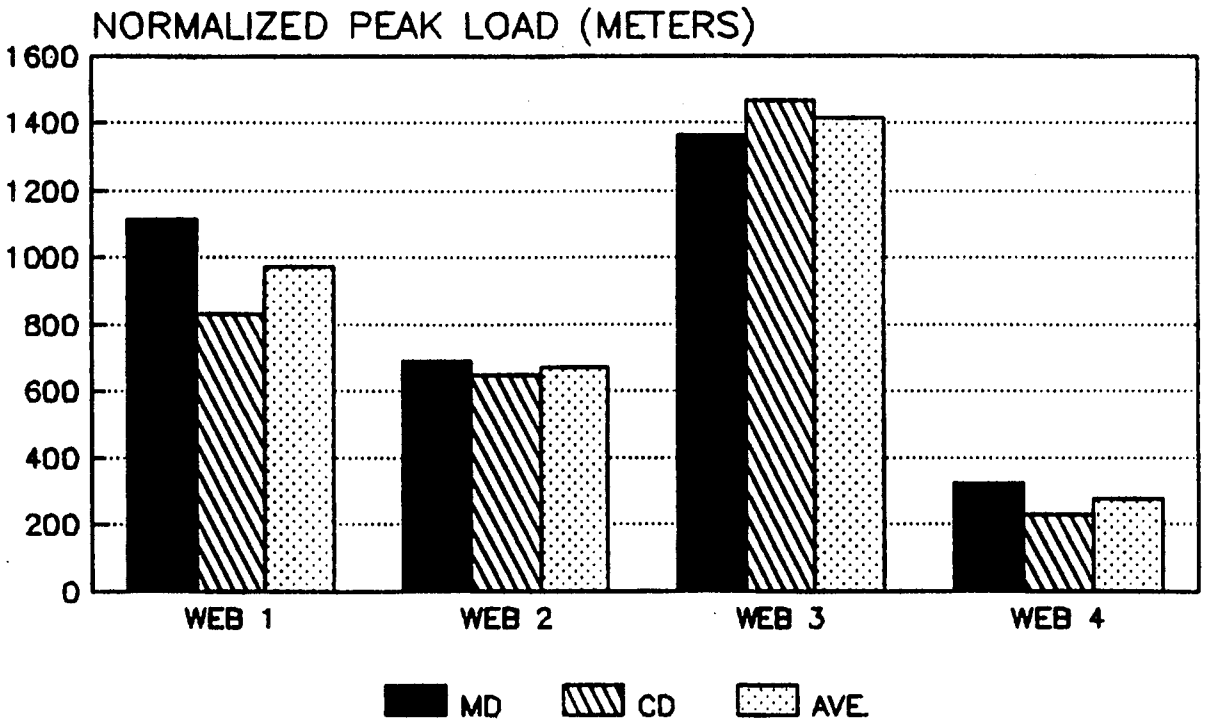
FIGS. 16–20 are bar graphs illustrating various tensile and tear characteristics of several nonwoven webs prepared in accordance with the present invention.
Figure 17:
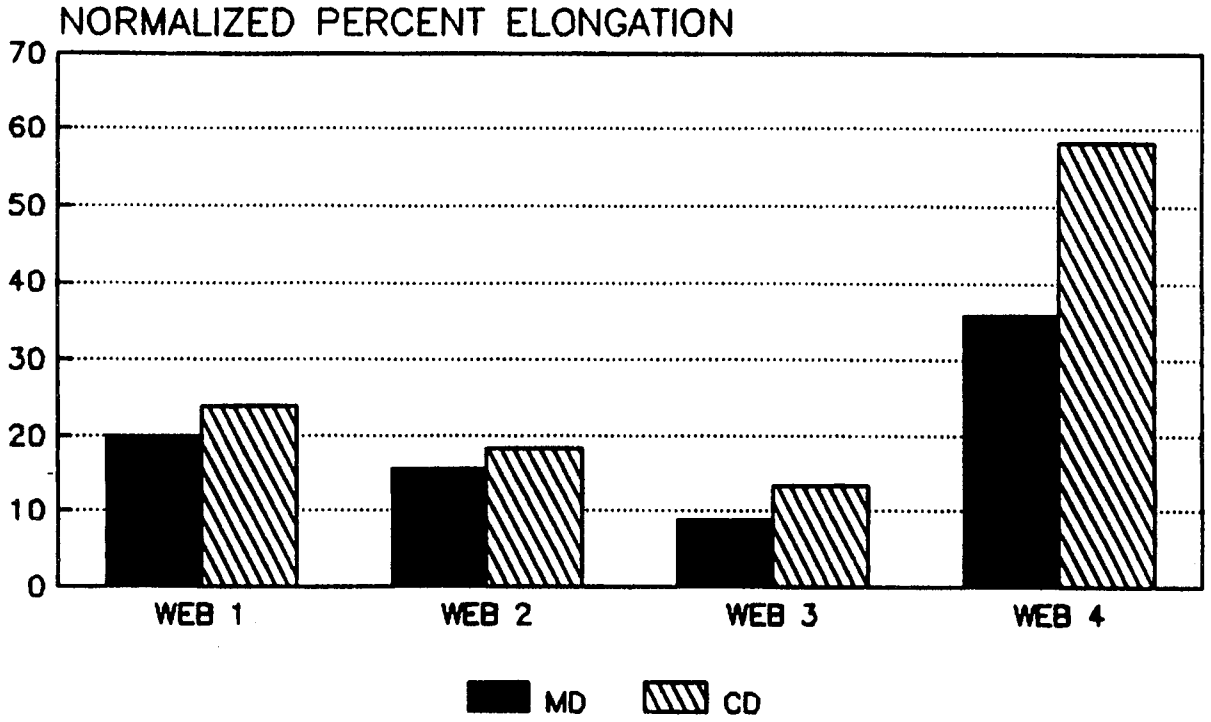
Figure 18:
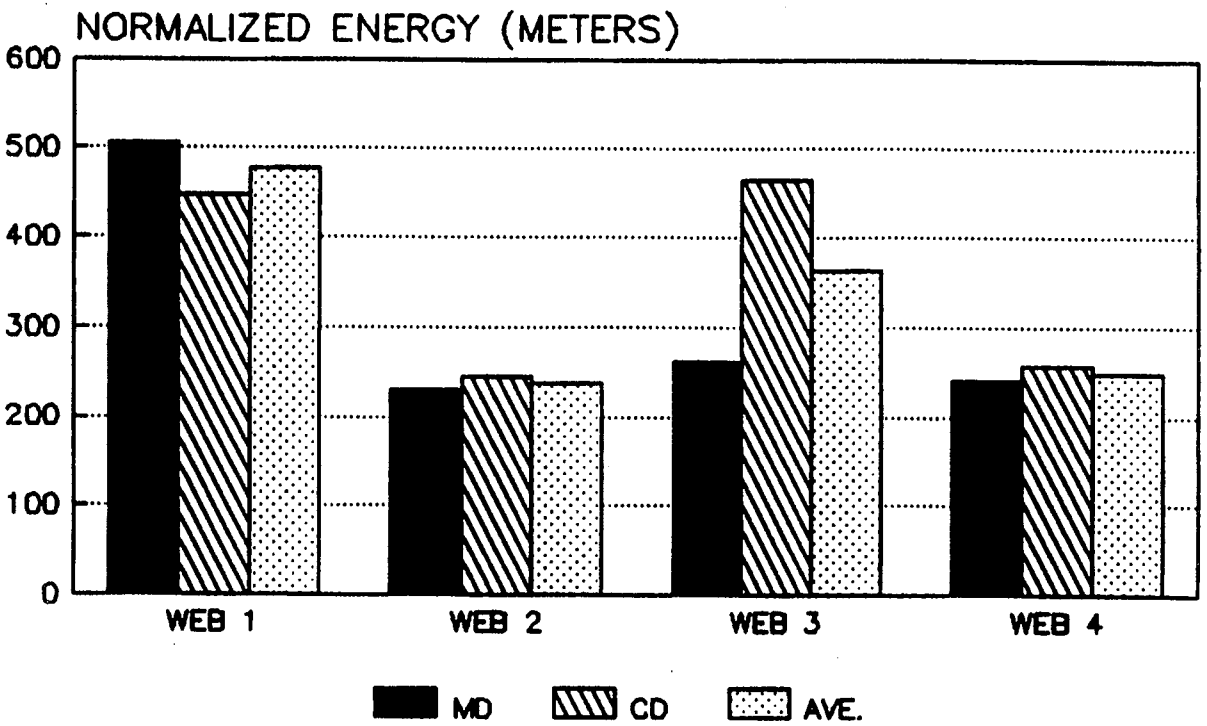
Figure 19:
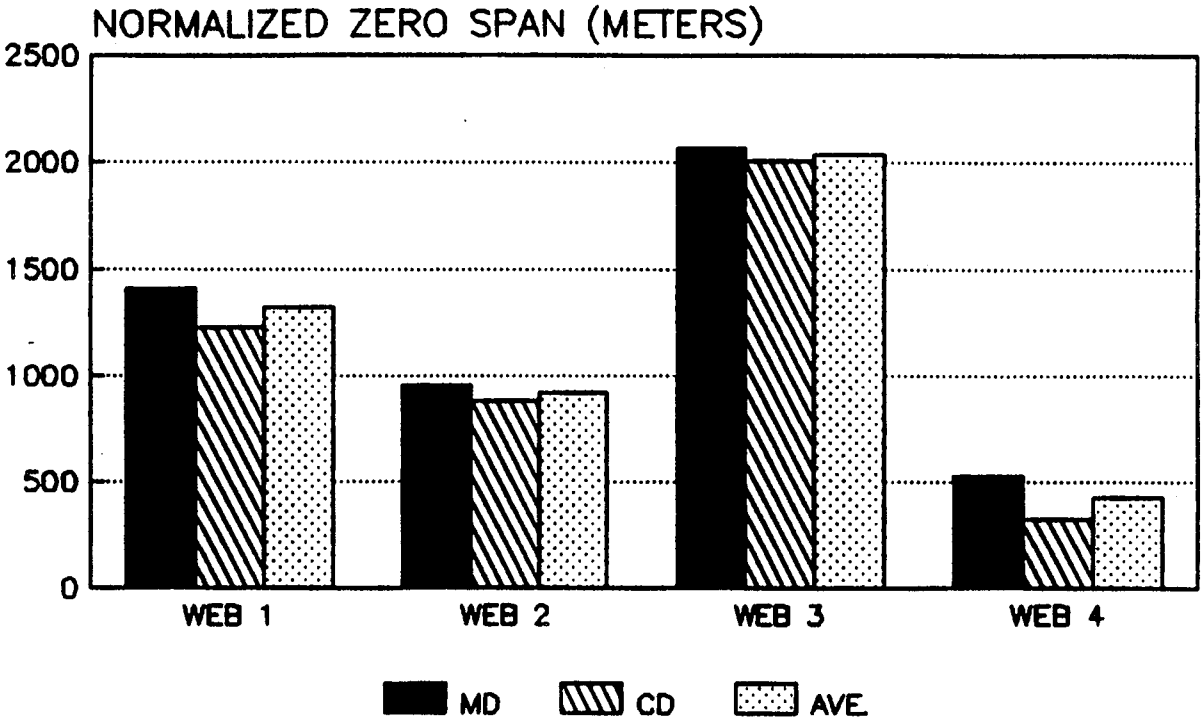
Figure 20:
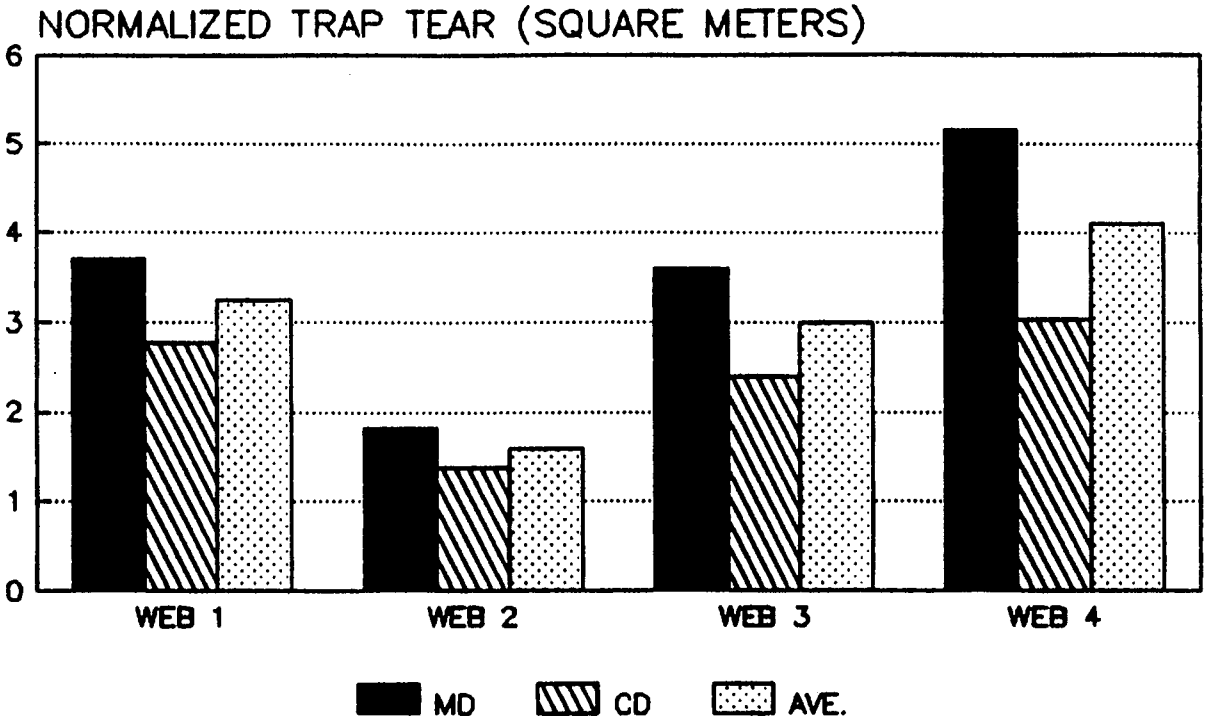

To assist in the visualization of the data shown in Tables 2-7 to 2-11, the data were plotted as bar graphs, with separate bars for MD data, CD data, and the average of the MD and CD data, respectively. Such plots are shown in FIGS. 16–20, respectively. Thus, the plot for the data of Table 2-7 is shown in FIG. 16, the plot for the data of Table 2-8 is shown in FIG. 17, and so on.

EXAMPLE 3

In order to prepare a coformed web, the procedure of Example 2 was repeated separately with solutions 2 and 3. A largely softwood pulp sheet (Coosa CR-54, manufactured by Kimberly-Clark Corporation at its Coosa Pines, Ala., Mill) was fiberized with a hammer mill and then blown with air at a velocity of 24 m/s through a rectangular duct having a depth of 2.5 cm. The dilution rate, defined as g of fiberized pulp per cubic meter of carrier air volume, was kept in the range of from about 2.8 to about 8.5 to minimize flocculation. The resulting air-borne fiber stream then was injected into the threadline-carrying first secondary gaseous stream at the region where the threadline-carrying first secondary gaseous stream and second secondary gaseous stream met. Both the vertical and horizontal angles of incidence of the air-borne fiber stream were about 90°; the stream exited the rectangular duct about 10 cm from the region where the two secondary gaseous streams met.

In each case, the resulting coformed web was well integrated and strong, but soft, bulky, and absorbent. The web was composed of 50–75 percent by weight of pulp fibers and had a basis weight of about 80 g/m$^2$. A roll of one web was thermally embossed at about 75° C. to give a much stronger web which remained soft and bulky; care was taken to avoid completely drying the poly(vinyl alcohol) fibers. Such coformed webs are especially useful as wipes or as components of other absorbent products.

Having thus described the invention, numerous changes and modifications thereof will be readily apparent to those having ordinary skill in the art without departing from the spirit or scope of the invention.

What is claimed is:

1. A nonwoven web comprised of substantially continuous poly(vinyl alcohol) fibers, in which:

A. said poly(vinyl alcohol) has a molecular weight of from about 30,000 to about 186,000 and a degree of hydrolysis of from about 71 to about 99 percent;

B. said fibers have a means fiber diameter in a range of from about 0.1 to about 10 μm, are substantially free of shot, and are substantially continuous in that they are of a length such that they can be regarded as continuous in comparison with their diameters; and C. said web is substantially uniform on a scale of from about 0.4 to about 1.9 cm$^2$ of web area.

2. The nonwoven web of claim 1, in which said substantially continuous poly(vinyl alcohol) fibers have intermingled therewith from about 10 to about 90 percent by weight, based on a weight of the nonwoven web, of a fibrous or particulate material.

3. The nonwoven web of claim 2, in which said fibrous or particulate material is wood pulp.

4. A disposable absorbent product which includes the nonwoven web of claim 2.

5. The disposable absorbent product of claim 4, in which said disposable absorbent product is a diaper.

6. The disposable absorbent product of claim 4, in which said disposable absorbent product is a training pant.

7. The disposable absorbent product of claim 4, in which said disposable absorbent product is a catamenial device.

8. The disposable absorbent product of claim 7, in which said disposable absorbent product is a sanitary napkin.

9. The disposable absorbent product of claim 7, in which said disposable absorbent product is a tampon.

10. The disposable absorbent product of claim 4, in which said disposable absorbent product is an incontinent product.

11. The disposable absorbent product of claim 4, in which said disposable absorbent product is a wipe.

12. A disposable absorbent product which includes the nonwoven web of claim 1.

13. The disposable absorbent product of claim 12, in which said disposable absorbent product is a diaper.

14. The disposable absorbent product of claim 12, in which said disposable absorbent product is a training pant.

15. The disposable absorbent product of claim 12, in which said disposable absorbent product is a catamenial device.

16. The disposable absorbent product of claim 15, in which said disposable absorbent product is a sanitary napkin.

17. The disposable absorbent product of claim 15, in which said disposable absorbent product is a tampon.

18. The disposable absorbent product of claim 12, in which said disposable absorbent product is an incontinent product.

19. The disposable absorbent product of claim 12, in which said disposable absorbent product is a wipe.

20. A nonwoven web comprised of continuous poly(-vinyl alcohol) fibers, in which:

A. said poly(vinyl alcohol) has a molecular weight of from about 30,000 to about 186,000 and a degree of hydrolysis of from about 71 to about 99 percent;

B. said fibers have a mean fiber diameter in a range of from about 10 to about 30 μm and are substantially uniform in diameter; and C. said web is substantially uniform on a scale of from about 1.9 to about 6.5 $cm^2$ of web area.

21. A disposable absorbent product which includes the nonwoven web of claim 20.

22. The disposable absorbent product of claim 21, in which said disposable absorbent product is an incontinent product.

23. The disposable absorbent product of claim 21, in which said disposable absorbent product is a wipe.

24. The disposable absorbent product of claim 21, in which said disposable absorbent product is a diaper.

25. The disposable absorbent product of claim 21, in which said disposable absorbent product is a training pant.

26. The disposable absorbent product of claim 21, in which said disposable absorbent product is a catamenial device.

27. The disposable absorbent product of claim 26, in which said disposable absorbent product is a sanitary napkin.

28. The disposable absorbent product of claim 26, in which said disposable absorbent product is a tampon.

* * * * *

UNITED STATES PATENT AND TRADEMARK OFFICE

CERTIFICATE OF CORRECTION

PATENT NO. : 5,342,335

DATED : August 30, 1994

INVENTOR(S) : Hannong Rhim

It is certified that error appears in the above-identified patent and that said Letters Patent is hereby corrected as shown below:

Column 4, line 54, "with a 2.0 primary" should read --with a primary--;

Column 13, line 28, "turbulence
(i.e., web..."

should read
--turbulence (i.e., web...--
(No new paragraph)

Column 20, line 38, "200-1,000 rpm Optionally" should read --200-1,000 rpm. Optionally--.

Signed and Sealed this

Fourteenth Day of November, 1995

*Attest:*

*Attesting Officer*

BRUCE LEHMAN

*Commissioner of Patents and Trademarks*